US011771127B2

(12) United States Patent
Gao et al.

(10) Patent No.: US 11,771,127 B2
(45) **Date of Patent: *Oct. 3, 2023**

(54) CHEWABLE DISSOLVABLE NICOTINE TABLET

(71) Applicant: ALTRIA CLIENT SERVICES LLC, Richmond, VA (US)

(72) Inventors: Feng Gao, Midlothian, VA (US); Diane L. Gee, Chesterfield, VA (US); Shuzhong Zhuang, Glen Allen, VA (US); Phillip M. Hulan, Midlothian, VA (US); William J. Burke, Nashville, TN (US)

(73) Assignee: Altria Client Services LLC, Richmond, VA (US)

( * ) Notice: Subject to any disclaimer, the term of this patent is extended or adjusted under 35 U.S.C. 154(b) by 1018 days.

This patent is subject to a terminal disclaimer.

(21) Appl. No.: 14/505,814

(22) Filed: Oct. 3, 2014

(65) Prior Publication Data

US 2015/0096573 A1 Apr. 9, 2015

Related U.S. Application Data

(60) Provisional application No. 61/886,355, filed on Oct. 3, 2013.

(51) Int. Cl.
*A24B 13/00* (2006.01)
*A24B 15/16* (2020.01)

(52) U.S. Cl.
CPC ..... *A24B 13/00* (2013.01); *A24B 15/16* (2013.01)

(58) Field of Classification Search
CPC ..... A24B 13/00; A24B 15/16
See application file for complete search history.

(56) References Cited

U.S. PATENT DOCUMENTS 2,162,738 A 6/1939 McCoy
3,139,436 A 6/1964 Bicking
3,396,735 A 8/1968 Bethmann et al.
4,153,063 A 5/1979 Roselius et al.
4,448,208 A 5/1984 Friedrich et al.
4,516,590 A 5/1985 Teng
4,528,993 A 7/1985 Sensaubaugh, Jr. et al.
4,660,577 A 5/1987 Sensaubaugh et al.
4,848,373 A 7/1989 Lenkey
4,987,907 A 1/1991 Townend
5,236,719 A 8/1993 Meyers et al.
5,372,149 A 12/1994 Roth et al.
5,380,717 A 1/1995 Ohkuma et al.
5,410,035 A 4/1995 Wakabayashi et al.
5,487,792 A 1/1996 King et al.
6,203,842 B1 3/2001 Reddy
6,264,981 B1 * 7/2001 Zhang ..... A61K 9/0056 424/451
7,798,151 B2 9/2010 Krukonis et al.
2004/0118422 A1 6/2004 Lundin et al.
2005/0002996 A1 * 1/2005 Sojka ..... A61K 8/027 424/445
2005/0178398 A1 8/2005 Breslin et al.
2005/0244521 A1 * 11/2005 Strickland ..... A24B 13/00 424/751
2007/0196396 A1 * 8/2007 Pilgaonkar ..... A61K 9/0065 424/400
2008/0209586 A1 8/2008 Nielsen et al.
2009/0202635 A1 * 8/2009 Scott ..... A61K 9/7007 424/464
2009/0293889 A1 * 12/2009 Kumar ..... A23G 3/48 131/275
2010/0291245 A1 * 11/2010 Gao ..... A24B 15/18 424/729
2013/0071476 A1 * 3/2013 Cherukuri ..... A61K 9/2081 424/465
2013/0118512 A1 * 5/2013 Jackson ..... A24B 13/00 131/355
2013/0186416 A1 * 7/2013 Gao ..... A24F 47/002 131/275
2013/0186418 A1 * 7/2013 Gao ..... A24B 13/00 131/275
2013/0206150 A1 * 8/2013 Duggins ..... A24B 13/00 131/111

FOREIGN PATENT DOCUMENTS

WO WO 2005/046363 5/2005
WO WO 2013/109961 7/2013

OTHER PUBLICATIONS

International Preliminary Report on Patentability in International Application No. US2014/059144, dated Apr. 14, 2016, 6 pages.
U.S. Appl. No. 14/333,877, filed Jul. 17, 2014, Gao et al.
International Search Report and Written Opinion in International Application No. US2014/059144, dated Dec. 12, 2014, 9 pages.
Tso, Tobacco Production, "Seed to Smoke," Chemistry and Technology, Blackwell Publishing, 1999, 1-31.

* cited by examiner

*Primary Examiner* — Robert A Wax
*Assistant Examiner* — Olga V. Tcherkasskaya
(74) *Attorney, Agent, or Firm* — Harness, Dickey & Pierce, P.L.C.

(57) ABSTRACT

A nicotine tablet that includes a solid solution of soluble fiber and one or more sugar alcohols, the solid solution having a glass transition temperature of less than 40° C., and nicotine or a derivative thereof dispersed in the solid solution such that the nicotine or derivative thereof is released from the tablet when the tablet is chewed or dissolved within an oral cavity.

20 Claims, 11 Drawing Sheets

CHEWABLE DISSOLVABLE NICOTINE TABLET

CROSS REFERENCE TO RELATED APPLICATIONS

This application claims the benefit of priority under 35 U.S.C. § 119(e) to U.S. Application No. 61/886,355 filed Oct. 3, 2013. The prior application is incorporated herein by reference in its entirety.

TECHNICAL FIELD

This document relates to chewable dissolvable nicotine tablets and methods for making chewable dissolvable nicotine tablets. For example, a chewable dissolvable nicotine tablets can include nicotine within a solid solution of soluble fiber and one or more sugar alcohols.

BACKGROUND

Tobacco can be enjoyed by adult tobacco consumers in a variety of forms. Smoking tobacco is combusted and the aerosol either tasted or inhaled (e.g., in a cigarette, cigar, or pipe). Smokeless tobacco products are not combusted and include: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

Nicotine is a component of various tobacco products. Over the years, however, various methods and systems have been developed for providing nicotine to adult consumers without the presence of tobacco plant tissue. Some ways nicotine, in the absence of tobacco, is provided include transdermal patches, lozenges, and nicotine chewing gums.

Nicotine, or 3-(1-methyl-2-pyrrolidinyl) pyridine, is a tertiary amine with the following structure:

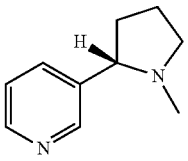

Under ambient conditions, nicotine is an oily, volatile, hygroscopic liquid that is sensitive to light and air. Chemical and physical properties of nicotine present a number of processing and stability issues. For example, because nicotine is volatile, it may evaporate during its incorporation into a gum or lozenge. In an effort to reduce potential processing and stability issues associated with the nicotine compound, a number of nicotine complexes have been developed. For example, one method includes the preparation of a complex of nicotine and an ion exchange resin. A well-known complex that is currently used in the commercially-available nicotine chewing gums is nicotine polacrilex, which is a complex of nicotine and the cation exchange resin AMBERLITE 164.

SUMMARY

A chewable dissolvable nicotine tablet provided herein provides a satisfying tactile and/or flavor experience. A chewable dissolvable nicotine tablet provided herein is at least partially receivable in an oral cavity of an adult consumer. In some cases, a chewable dissolvable nicotine tablet provided herein is wholly receivable in an oral cavity. A chewable dissolvable nicotine tablet provided herein can include a solid solution of soluble fiber and one or more sugar alcohols, with nicotine or a derivative thereof dispersed in the solid solution. In some cases, a chewable dissolvable nicotine tablet provided herein can include unbound nicotine. In some cases, a chewable dissolvable nicotine tablet provided herein includes at least 20 weight percent of soluble fiber. In some cases, soluble fiber in a chewable dissolvable nicotine tablet provided herein can include digestion-resistant maltodextrin. In some cases, a chewable dissolvable nicotine tablet provided herein includes at least 20 weight percent of one or more sugar alcohols. A chewable dissolvable nicotine tablet provided herein can be adapted to release the nicotine or a derivative thereof therefrom when received within the oral cavity of an adult consumer and/or chewed by an adult consumer.

A solid solution of soluble fiber and one or more sugar alcohols provided herein can have a glass transition temperature selected to provide a stable product at ambient temperatures, but that is chewable at body temperature. For example, by using the relatively high soluble fiber content, the glass transition temperature of a chewable dissolvable nicotine tablet provided herein can be selected such that it is relatively close to ambient temperature, which can permit an adult consumer to experience an enjoyable tactile experience (e.g., mouth feel). A chewable dissolvable nicotine tablet provided herein can include a single and continuous phase of the solid solution and dispersed additives (e.g., oil, cellulosic fiber). At ambient temperatures, the solid solution can be amorphous and glassy.

A method of making chewable dissolvable nicotine tablets provided herein can include forming a molten mixture of at least 20 weight percent soluble fiber, at least 20 weight percent of one or more sugar alcohols, nicotine, and less than 15 weight percent water while maintaining a mixture temperature of less than 150° C., and portioning the molten mixture into a plurality of chewable dissolvable nicotine tablets. In some cases, the ingredients can be mixed to form the molten mixture in an extruder and individual chewable dissolvable nicotine tablets formed from the molten mixture as it leaves the extruder. Plasticizers, such as oil, can be added to the molten mixture (e.g., in an extruder). In some cases, oil is added to increase the chewiness of a chewable dissolvable nicotine tablet provided herein. In some cases, oil can be added to a molten mixture to cool the molten mixture to a temperature such that the molten mixture becomes a solid solution having some shape stability.

Unlike a traditional cooking process where sugars or sugar alcohols are heated to a temperature such that caramelization and other cross-linking occurs (e.g., greater than 160° C.), methods provided herein include a controlled mixing and heating of soluble fiber and sugar alcohols to form a molten mixture and dispersing nicotine (and optionally other ingredients) in the solid solution without creating significant crosslinking of the sugar alcohols. Because nicotine degradation can be accelerated when exposed to elevated temperatures over extended periods of time, the temperature of a molten mixture provided herein can be maintained at a temperature of 150° C. or below over a residence time of five to ten minutes or less during the mixing (for example, if an extrusion process is utilized). In some cases, a molten mixture provided herein is heated to a maximum temperature of between 80° C. and 150° C. In some cases, a molten mixture provided herein is heated to a temperature of between 100° C. and 110° C. When cooled to ambient temperatures, a molten mixture provided herein solidifies into an amorphous, non-porous, glassy, body consisting of a single and continuous phase of the solid solution and dispersed additives (e.g., oil, cellulosic fiber). Because the soluble fibers and sugar alcohols do not become cross-linked, they can remain soluble and thus dissolve when placed in an adult consumer's mouth.

In some cases, a chewable dissolvable nicotine tablet provided herein can include a digestion-resistant soluble fiber. In some cases, a chewable dissolvable nicotine tablet provided herein can include a digestion-resistant maltodextrin derived from maze. For example, Fibersol®-2 is a digestion-resistant corn-derived maltodextrin soluble fiber, which can be used as the soluble fiber in a chewable dissolvable nicotine tablet provided herein. Other starch sources such as potato, rice, wheat, barley, peas, beans, lentils, oats, or tapioca can be processed to form digestion-resistant soluble fiber. A digestion resistant soluble fiber can include starch linkages that remain undigested by enzymes of the human digestive tract. Soluble fiber used in a chewable dissolvable nicotine tablet provided herein can be a soluble fiber generally recognized as safe ("GRAS") by the Food and Drug Administration or another appropriate private, state, or national regulatory agency.

In some cases, a chewable dissolvable nicotine tablet provided herein can include one or more sugar alcohols selected from the following group: mannitol, sorbitol, xylitol, erythritol, isomalt, lactitol, maltitol, maltitol syrup, and hydrogenated starch hydrolysates [HSH]. In some cases, a chewable dissolvable nicotine tablet provided herein can include two or more sugar alcohols. In some cases, a chewable dissolvable nicotine tablet provided herein can include mannitol and sorbitol. Sugar alcohols used in a chewable dissolvable nicotine tablet provided herein can be generally recognized as safe ("GRAS") by the Food and Drug Administration or another appropriate private, state, or national regulatory agency.

A chewable dissolvable nicotine tablet provided herein can, in some cases, include up to 15 weight percent water. In some cases, a chewable dissolvable nicotine tablet provided herein can include between 0.5 weight percent and 7 weight percent water. In some cases, a chewable dissolvable nicotine tablet provided herein can include between 1 weight percent and 5 weight percent water. In some cases, a chewable dissolvable nicotine tablet provided herein can include between 2 weight percent and 4 weight percent water.

Nicotine or derivatives thereof added to a chewable dissolvable nicotine tablet provided herein can be in any suitable form. In some cases, a chewable dissolvable nicotine tablet provided herein includes between 0.1 mg and 20 mg nicotine. In some cases, nicotine in a chewable dissolvable nicotine tablet provided herein includes tobacco-derived nicotine. In some cases, nicotine in a chewable dissolvable nicotine tablet provided herein includes synthetic nicotine. A chewable dissolvable nicotine tablet provided herein, in some cases, can be substantially free of tobacco plant tissue.

A chewable dissolvable nicotine tablet provided herein can include cellulose fibers. Combining liquid nicotine with cellulosic fiber as provided herein can provide stabilized nicotine that can be added to a chewable dissolvable nicotine tablet provided herein in a method provided herein. In some cases, liquid nicotine is added to cellulosic fibers prior to mixing the cellulosic fibers and nicotine a mixture of soluble fiber and one or more sugar alcohols. Cellulosic fibers can be derived from plant tissue. In some cases, the cellulosic fibers include cellulose. Cellulosic fibers can further include lignin and/or lipids. Cellulosic fibers can be non-tobacco cellulosic fibers. In some cases, a chewable dissolvable nicotine tablet provided herein can include between 0.01 weight percent and 40 weight percent cellulosic fibers. In some cases, a chewable dissolvable nicotine tablet provided herein can include between 5 weight percent and 40 weight percent cellulosic fibers. In some cases, a chewable dissolvable nicotine tablet provided herein can include between 10 weight percent and 40 weight percent cellulosic fibers. In some cases, a chewable dissolvable nicotine tablet provided herein can include between 15 weight percent and 40 weight percent cellulosic fibers. In some cases, a chewable dissolvable nicotine tablet provided herein can include between 20 weight percent and 40 weight percent cellulosic fibers. In some cases, a chewable dissolvable nicotine tablet provided herein can include between 25 weight percent and 40 weight percent cellulosic fibers. In some cases, a chewable dissolvable nicotine tablet provided herein can include between 30 weight percent and 40 weight percent cellulosic fibers.

A chewable dissolvable nicotine tablet provided herein can include a sweetener dispersed therein. Suitable sweeteners include saccharine, sucralose, aspartame, acesulfame potassium, and combinations thereof. In some cases, a chewable dissolvable nicotine tablet provided herein can be substantially free of sugars. For example, a chewable dissolvable nicotine tablet can be substantially free of sugars, but include one or more sugar alcohols and non-nutritive sweeteners. In some cases, a chewable dissolvable nicotine tablet provided herein can include non-caramelized sugars in a percentage of no more than 25 weight percent.

A chewable dissolvable nicotine tablet provided herein can include flavorants. The flavorants can be natural or artificial. Flavorants can be selected from the following: licorice, wintergreen, cherry and berry type flavorants, Drambuie, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang ylang, sage, fennel, pimenta, ginger, anise, chai, coriander, coffee, mint oils from a species of the genus Mentha, cocoa, and combinations thereof. Synthetic flavorants can also be used. In some cases, a combination of flavorants can be combined to imitate a tobacco flavor. The particular combination of flavorants can be selected from flavorants that are GRAS in a particular country, such as the United States. Flavorants can also be included in the chewable dissolvable nicotine tablet as encapsulated flavorants.

A chewable dissolvable nicotine tablet provided herein can include a plasticizer dispersed in the solid solution. For example, the plasticizer can be propylene glycol, triacetin, glycerin, vegetable oil, partially hydrogenated oil, triglycerides, triacetin or a combination thereof. Plasticizers can be added as processing aids and/or to make a chewable dissolvable nicotine tablet chewier. In some cases, oil can be added to a molten mixture including sugar alcohol(s), soluble fibers, and nicotine to cool the molten mixture. In some cases, a chewable dissolvable nicotine tablet provided herein can include oil dispersed within a matrix of a solid solution provided herein.

A body of a chewable dissolvable nicotine tablet provided herein can have a variety of different shapes, some of which include disk, shield, heart, rectangle, and square. In some cases, a body of a chewable dissolvable nicotine tablet provided herein can have rounded corners. In some cases, the body of the chewable dissolvable nicotine tablet can be spherical. According to certain embodiments, the body can have a length or width of between 1 mm and 25 mm and a thickness of between 1 mm and 25 mm. In some cases, the body can have a length or width of between 5 mm and 15 mm and a thickness of between 2 mm and 5 mm. In some cases, a chewable dissolvable nicotine tablet provided herein can include a colorant. For example, a body of a chewable dissolvable nicotine tablet provided herein can include titanium dioxide, which can provide the body with a white color. In some cases, a coating on the body can include a colorant.

A method of forming chewable dissolvable nicotine tablets can include forming a molten mixture of at least 20 weight percent soluble fiber, at least 20 weight percent of one or more sugar alcohols, nicotine, and less than 15 weight percent water, while maintaining a mixture temperature of less than 150° C. In some cases, the molten mixture includes at less than 13 weight percent, less than 10 weight percent, less than 8 weight percent, less than 7 weight percent, less than 6 weight percent, or less than 5 weight percent water. In some cases, the molten mixture includes at least 0.5 weight percent, at least 1 weight percent, at least 2 weight percent, or at least 3 weight percent water. In addition to nicotine, water, sugar alcohol(s) and soluble fiber (e.g., maltodextrin), a molten mixture provided herein can include one or more additives selected from colorants, sweeteners, flavorants, plasticizers, antioxidants, processing aid, and combinations thereof. In some cases, the molten mixture is substantially free of tobacco plant tissue and/or sugars.

In some cases, the molten mixture provided herein is formed in an extruder. The extruder can be a multi-staged extruder having different sections that are heated to different temperatures and/or have different ingredients introduced. In some cases, an extruder provided herein can include multiple stages and can be used in a method provided herein in a process where the maximum temperature in any stage is no more than 150° C. (e.g., no more than 120° C., no more than 110° C., or no more than 105° C.). Portioning the molten mixture provided herein can be accomplished using any suitable method. A method provided herein can further include cooling chewable dissolvable nicotine tablets and packaging chewable dissolvable nicotine tablets.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

Figure 1:
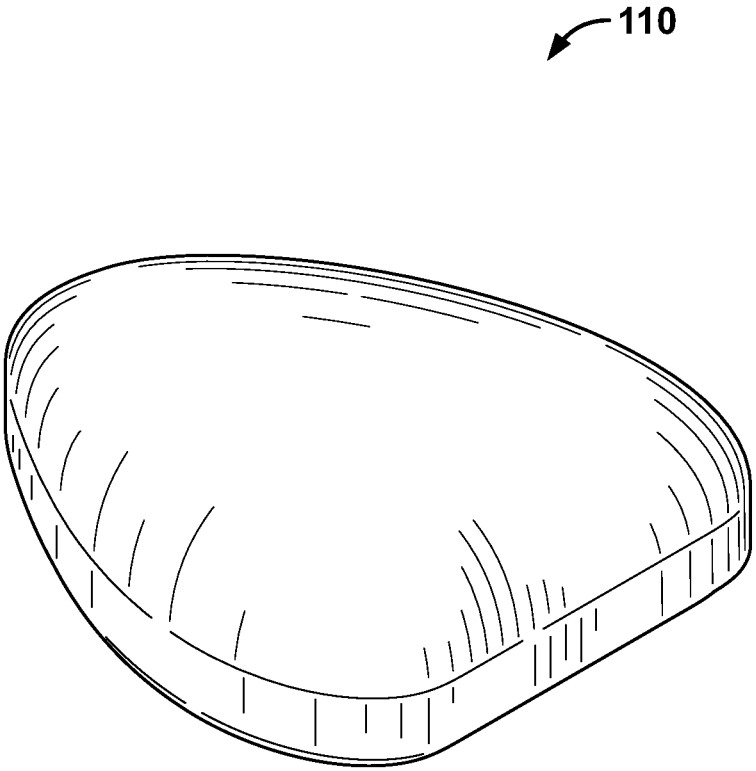
FIG. 1 is a perspective view of a chewable dissolvable nicotine tablet provided herein.

The chewable dissolvable nicotine tablets described herein include a solid solution of soluble fiber and one or more sugar alcohols. Nicotine or a derivative thereof (and optionally additional additives) can be dispersed in the solid solution such that the one or more additives are released from the chewable dissolvable nicotine tablet when the chewable dissolvable nicotine tablet is chewed and/or dissolved within an oral cavity. The chewable dissolvable nicotine tablets described herein can provide a favorable additive release profile and tactile experience. In some cases, a chewable dissolvable nicotine tablet provided herein includes unbound nicotine in the solid solution and/or absorbed into cellulosic fibers dispersed in a matrix of the solid solution.

Unlike traditional cooking processes, which typically solidify the ingredients by heating the ingredients to a temperature such that sugars and/or sugar alcohols caramelize, chewable dissolvable nicotine tablets provided herein can be made by forming a solid solution of soluble fiber and one or more sugar alcohols in a controlled heating and mixing process maintained at a temperature of 150° C. or below. The solid solutions described herein exhibit a glass transition temperature (TO in the range of −75° C. to 25° C. Because liquid nicotine degradation can be accelerated when exposed to elevated temperatures over extended periods of time, maintaining a temperature of 150° C. or below with a residence time of five to ten minutes or less can produce a chewable dissolvable nicotine tablet that includes liquid nicotine dispersed in the tablet. In some cases, an extruder can be used for this controlled heating and mixing process. A desired texture of the chewable dissolvable tablet can be determined by the selection and weight percentages of the soluble fiber and sugar alcohol(s) and the mixing process conditions. In some cases, a chewable dissolvable nicotine tablet provided herein can include maltodextrin as the soluble fiber. In some cases, a chewable dissolvable nicotine tablet provided herein can include at least 20 weight percent maltodextrin. In some cases, the soluble fiber can be digestion resistant soluble fiber (e.g., digestion resistant maltodextrin such as Fibersol®-2). By changing the ratio of soluble fiber to sugar alcohols, the Tg of the mixture can be altered and therefore the desired final texture of the product. In some cases, plasticizers can be incorporated into a chewable dissolvable nicotine tablet provided herein to make it more chewable.

In addition to nicotine and/or derivatives thereof, one or more additional additives can be included in a chewable dissolvable nicotine tablet provided herein and adapted to be released from the chewable dissolvable nicotine tablet when the chewable dissolvable nicotine tablet is placed in an oral cavity and chewed by an adult consumer. In some cases, a chewable dissolvable nicotine tablet provided herein can include a combination of nicotine, sweeteners, and flavorants to mimic the flavor profile and tactile experience of certain tobacco products.

A chewable dissolvable nicotine tablet provided herein can take up to 1 hour to dissolve when placed in an adult consumer's mouth. Chewing can increase the rate of dissolution. In some cases, a chewable dissolvable nicotine tablet provided herein can take less than 1 minute or as long as 30 minutes to dissolve when placed in an adult consumer's mouth. In some cases, a chewable dissolvable nicotine tablet provided herein can take between 2 minutes and 15 minutes to dissolve when chewed in an adult consumer's mouth.

In some cases, a chewable dissolvable nicotine tablet can be substantially free of tobacco plant tissue. As used herein, the term "tobacco plant tissue" refers to processed or non-processed cellulosic parts (e.g., leaves, stems) of a member of the genus *Nicotiana*, but does not include extracts of tobacco (e.g., tobacco-derived nicotine). As used herein, "substantially free of tobacco plant tissue" means that the product includes less than 0.5 weight percent of tobacco plant tissue. For example, a chewable dissolvable nicotine tablet provided herein can include one or more organoleptic components extracted from raw or processed tobacco, yet be substantially free of tobacco plant tissue. In some cases, a chewable dissolvable nicotine tablet provided herein can include one or more organoleptic components extracted from raw or processed tobacco, yet include no tobacco plant tissue.

In addition to additives, sweeteners, and flavorants, a chewable dissolvable nicotine tablet provided herein can also include cellulosic fibers, fillers, plasticizers, and/or processing aids. Cellulosic fibers can at least partially absorb nicotine and/or other additives (e.g., sweeteners and/or flavorants). Fillers can also be included in the solid solution to alter the texture or pliability of the chewable dissolvable nicotine tablet. The solid solution can also include plasticizers, which can increase the softness and/or chewability of the chewable dissolvable nicotine tablet. Processing aids can also be present in the chewable dissolvable nicotine tablet and be used to facilitate shaping processes.

Chewable Dissolvable Nicotine Tablet Shapes and Packaging

FIG. 1 depicts an example of a chewable dissolvable nicotine tablet 110. Chewable dissolvable nicotine tablet 110 can have a length of about 16 mm, width of about 14 mm and a thickness of about 9 mm.

Figure 1A:
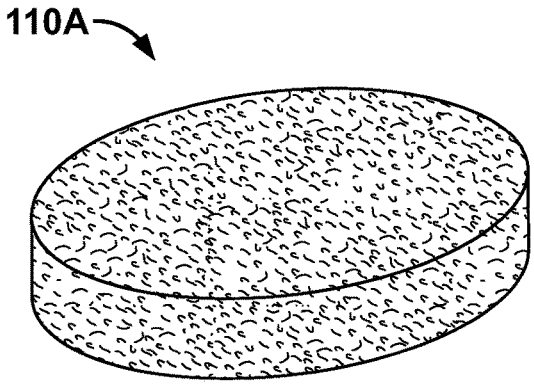
FIGS. 1A-1O illustrates various additional exemplary shapes of chewable dissolvable nicotine tablets provided herein.
Figure 1B:
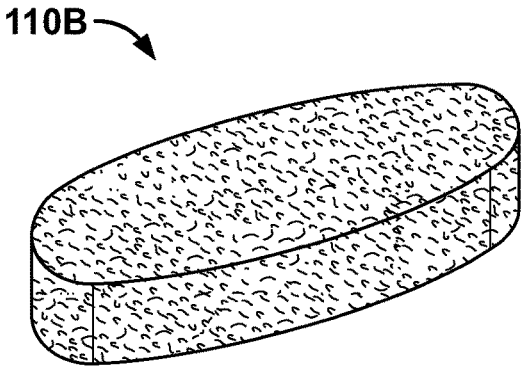
Figure 1C:
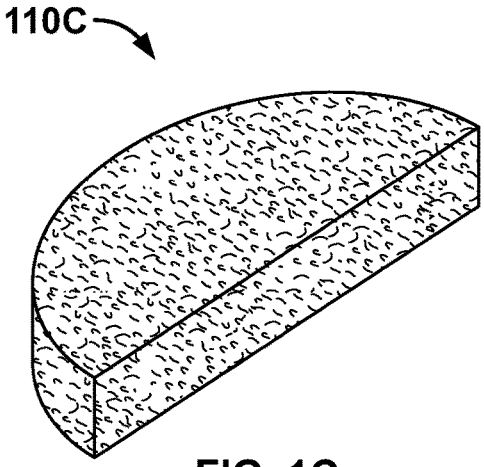
Figure 1D:
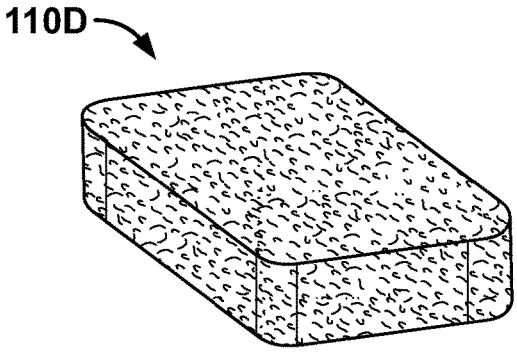
Figure 1E:
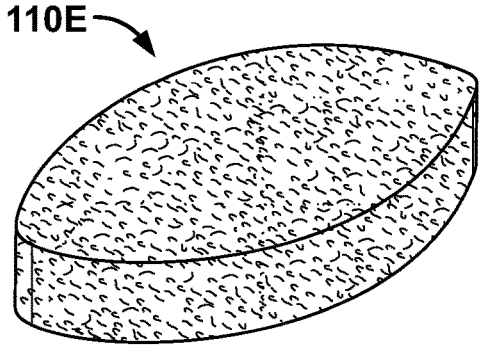
Figure 1F:
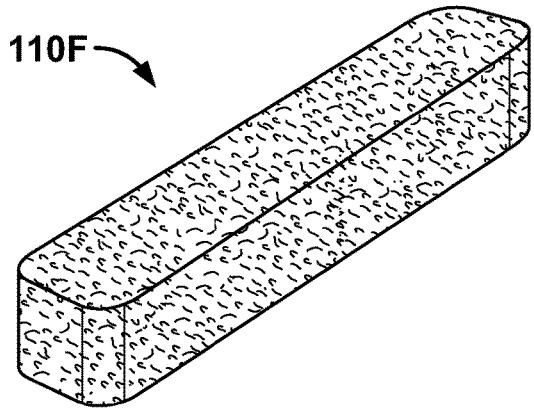
Figure 1G:
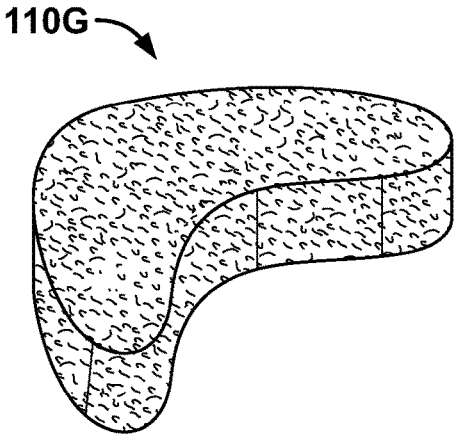
Figure 1H:
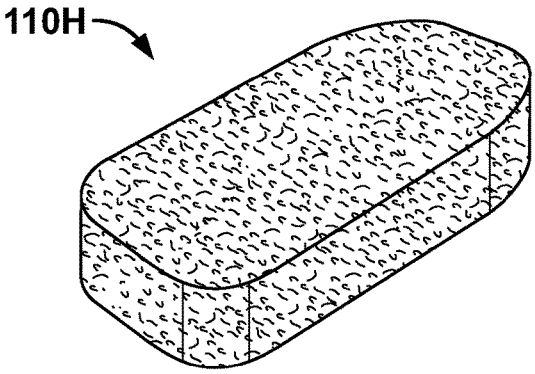
Figure 1I:
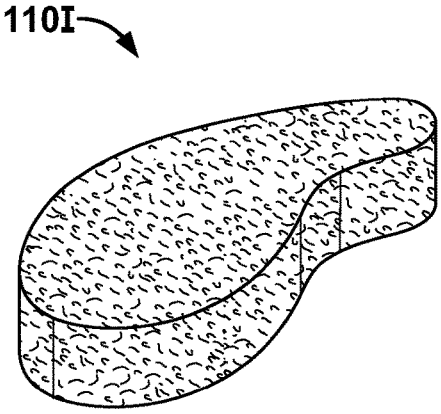
Figure 1J:
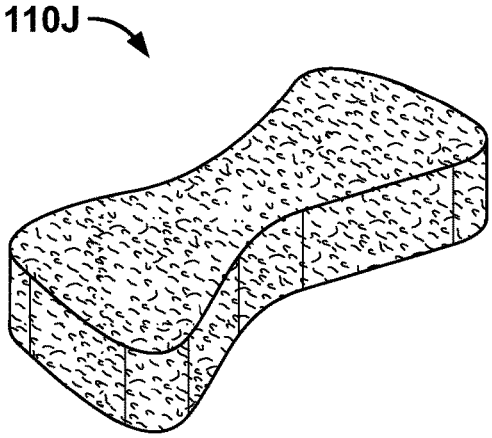
Figure 1K:
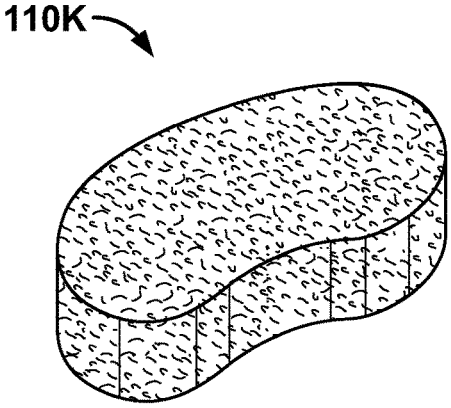
Figure 1L:
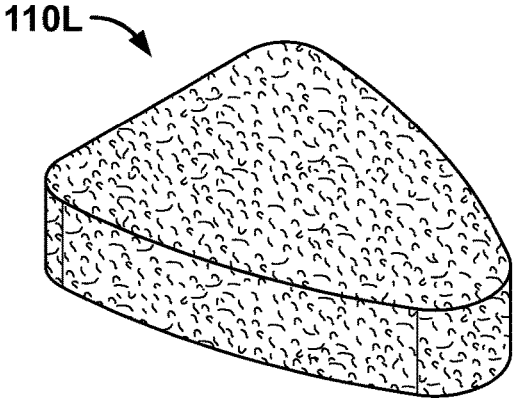
Figure 1M:
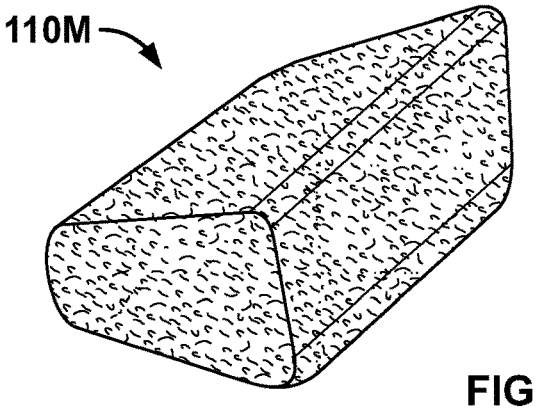
Figure 1N:
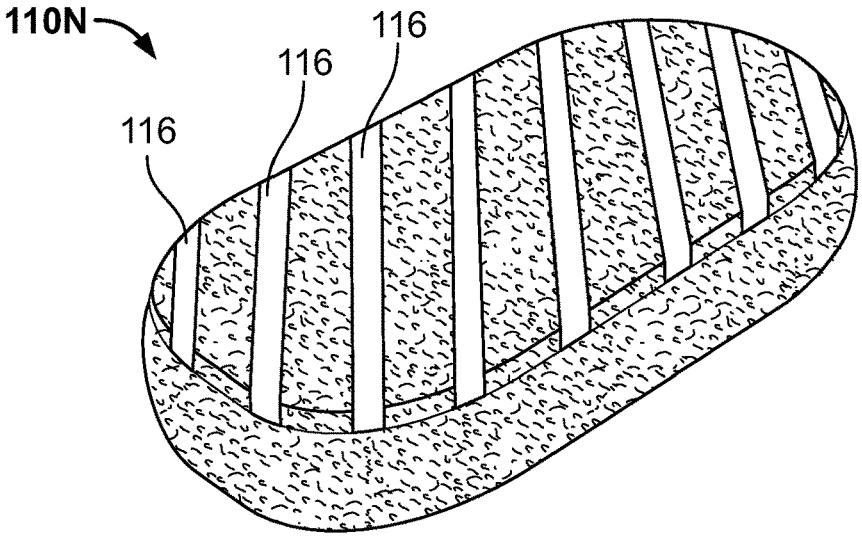

Referring now to FIGS. 1A-1N, the chewable dissolvable nicotine tablet 110 can be molded into any desired shape. For example, referring to FIGS. 1A-1L, the chewable dissolvable nicotine tablet 110A-L can be formed in a shape that promotes improved positioning in the oral cavity, improved packaging characteristics, or both. In some circumstances, the chewable dissolvable nicotine tablet 110A-L can be configured to be: (A) an elliptical-shaped chewable dissolvable nicotine tablet 110A; (B) an elongated elliptical-shaped chewable dissolvable nicotine tablet 110B; (C) semi-circular chewable dissolvable nicotine tablet 110C; (D) square or rectangular-shaped chewable dissolvable nicotine tablet 110D; (E) football-shaped chewable dissolvable nicotine tablet 110E; (F) elongated rectangular-shaped chewable dissolvable nicotine tablet 110F; (G) boomerang-shaped chewable dissolvable nicotine tablet 110G; (H) rounded-edge rectangular-shaped chewable dissolvable nicotine tablet 110H; (I) teardrop- or comma-shaped chewable dissolvable nicotine tablet 110I; (J) bowtie-shaped chewable dissolvable nicotine tablet 110J; (K) peanut-shaped chewable dissolvable nicotine tablet 110K; and (L) shield-shaped chewable dissolvable nicotine tablet. Alternatively, the chewable dissolvable nicotine tablet can have different thicknesses or dimensionality, such that a beveled article (e.g., a wedge) is produced (see, for example, product 110M depicted in FIG. 1M) or a hemi-spherical shape is produced. In some cases, the chewable dissolvable nicotine tablet has a shield shape.

In addition or in the alternative to flavorants being included within the soluble fiber matrix, flavorants can be included on an exterior of the chewable dissolvable nicotine tablet 110. For example, referring to FIG. 1N some embodiments of a chewable dissolvable nicotine tablet 110N can be equipped with flavor strips 116.

Figure 1O:
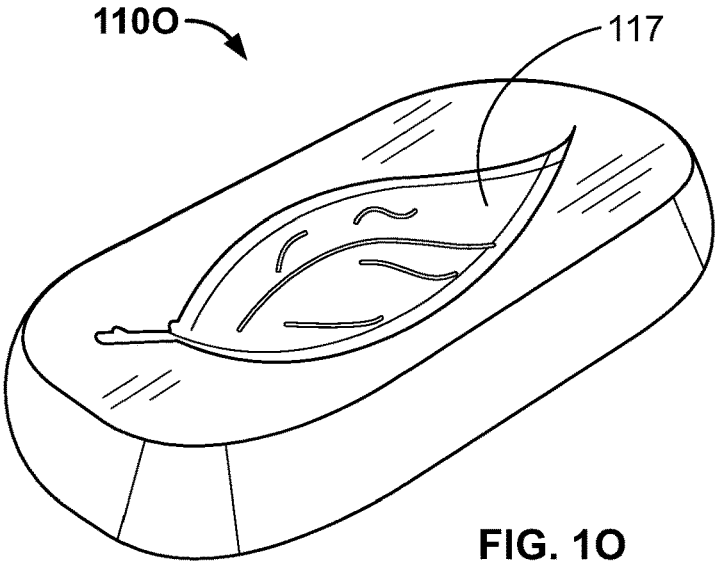

Referring to FIG. 1O, particular embodiments of the chewable dissolvable nicotine tablet 110 can be embossed or stamped with a design (e.g., a logo, an image, or the like). For example, the chewable dissolvable nicotine tablet 110O can be embossed or stamped with any type of design 117 including, but not limited to, a trademark, a product name, or any type of image. The design 117 can be formed directly into the chewable dissolvable nicotine tablet, arranged along the exterior of the product 110O. The design 117 can also be embossed or stamped into those embodiments with a dissolvable film 116 applied thereto.

In some cases, the chewable dissolvable nicotine tablet 110 can be wrapped or coated in an edible or dissolvable film, which may be opaque, substantially transparent, or translucent. The dissolvable film can readily dissipate when the chewable dissolvable nicotine tablet 110 is placed in an oral cavity. In some cases, the chewable dissolvable nicotine tablet 110 can be coated with a mouth-soluble material. Exemplary coating materials include Carnuba wax, Beeswax, gelatin, acetylated monoglyceride, starch (e.g., native potato starch, high amylose starch, hydroxypropylated potato starch), Zein, Shellac, ethyl cellulose, methylcellulose, hydroxypropyl methylcellulose, carboxymethyl cellulose, and combinations thereof. Additives, such as miglycol, titanium dioxide, kaoline, bentonite, can be incorporated into the coating material to improve oxygen or moisture barrier and mechanical properties for the coating or film. For example, a coating can include a combination of gelatin and methylcellulose or gelatin and hydroxymethylcellulose. In some cases, the coating can contain sugar alcohols such as sorbitol, mannitol, xylitol, erythritol), disaccharide-derived (e.g., isomalt, lactitol, maltitol), or polysaccharide-derived mixtures (e.g., maltitol syrup, hydrogenated starch hydrolysates [HSH]) or combinations thereof. In some cases a coating material can contain sugar alcohols and hydroxymethylcellulose, gelatin, wax, with additives. In some cases, a coating can include a colorant, a flavorant, and/or a one or more of the additives discussed above. For example, a coating can include nicotine to provide a user with readily available nicotine. In some cases, the solid solution can form a body that can have surfaces roughened to improve the adherence of a coating. In some cases, a coating can provide a glossy or semi-glossy appearance, a smooth surface, and/or an appealing visual aesthetic (e.g., a nice color). In some cases, the coating (e.g., a Beeswax, Zein, acetylated monoglyceride, and/or hydroxypropylated potato starch coating) can provide a soft mouth feel. In some cases, the coating (e.g., a methylcellulose, hydroxypropyl methylcellulose, carboxymethyl cellulose, ethyl cellulose, and/or gelatin coating) can provide a hard outer coating.

One or more chewable dissolvable nicotine tablets 110 can be packaged in a variety of conventional and non-conventional manners. For example, a plurality of chewable dissolvable nicotine tablets 110 can be packaged in a container having a lid. In some cases, a plurality of chewable dissolvable nicotine tablets 110 can be stacked and packaged in a paper, plastic, and/or aluminum foil tube. The packaging can have a child-resistant lid.

Chewable Dissolvable Nicotine Tablet Properties

The chewable dissolvable nicotine tablet 110 can provide a favorable tactile experience (e.g., mouth feel). While the chewable dissolvable nicotine tablet 110 can retain its shape during processing, shipping, handling, the chewable dissolvable nicotine tablet 110 includes a solid solution that dissolves or disintegrates when the chewable dissolvable nicotine tablet 110 is placed in an oral cavity, exposed to saliva, and/or chewed. To further promote a favorable tactile experience (e.g., mouth feel), in some cases, chewable dissolvable nicotine tablet 110 can be formulated to exhibit a smooth texture. Working of the chewable dissolvable nicotine tablet 110 within the oral cavity can accelerate the release of the nicotine within the solid solution.

Figure 2:
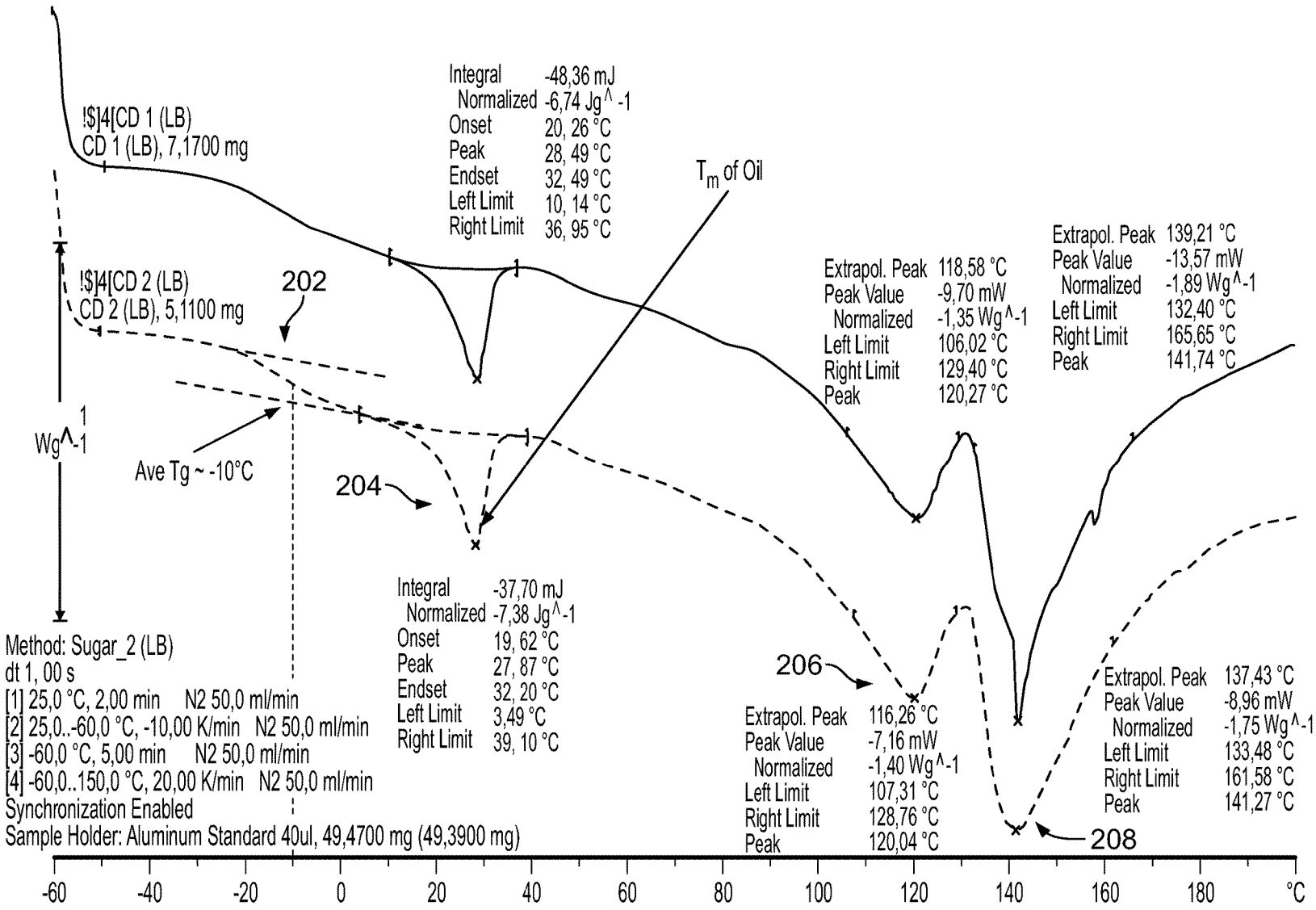
FIG. 2 depicts differential scanning calorimetry data for a chewable dissolvable nicotine tablet provided herein.

During use, the environment surrounding the chewable dissolvable nicotine tablet 110 transitions from room temperature (e.g., ~25° C.) to body temperature (e.g., ~37° C.). One way of characterizing the properties of the chewable dissolvable nicotine tablet 110 is by determining the phase transition points of a chewable dissolvable nicotine tablet using differential scanning calorimetry (DSC). The chewable dissolvable nicotine tablet 110 is composed of various ingredients, therefore, the thermal transitions of the chewable dissolvable nicotine tablet can differ not only due to the individual properties of each ingredient, but also due to the ratios of those ingredients. For example, FIG. 2 illustrates the thermal transitions of a chewable dissolvable nicotine tablet with approximately 30-40 weight percent of maltodextrin, a mixture of mannitol and sorbitol of approximately 30-40 weight percent, and water content from 0.5 weight percent to 7 weight percent. In some cases, a glass transition temperature ($T_g$) 202 of the chewable dissolvable nicotine tablet 110 can be from −65° C. to 40° C. (e.g., −50° C. to 40° C., −40° C. to 30° C., −30° C. to 20° C., −20° C. to 10° C., and −10° C. to 0° C.). As shown in FIG. 2, the approximate $T_g$ of this formulation can be from −20 to 10° C. Thus, at room temperature the chewable dissolvable nicotine tablet 110 is at the end of the transition from a glassy state to a rubbery/viscous state. Once the chewable dissolvable nicotine tablet 110 is placed in an oral cavity at body temperature, the chewable dissolvable nicotine tablet 110 can complete the phase transition to a rubbery/viscous state. In particular embodiments, the chewable dissolvable nicotine tablet 110 is coated to facilitate bulk packaging.

Still referring to FIG. 2, in some cases, a peak 204 at approximately 28° C. (82.4° F.) represents a melting transition point (Tm) of the oil dispersed in the chewable dissolvable nicotine tablet 110. As the chewable dissolvable nicotine tablet 110 is exposed to body temperature that exceeds the Tm of the oil, the oil undergoes a phase transition to a liquid state. This transition can provide a favorable tactile experience (e.g., mouth feel) to the user as it causes the chewable dissolvable nicotine tablet to soften. For example, referring to FIGS. 6A-6D, the multiple phases in the chewable dissolvable nicotine tablet are visible through x-ray microtomography. A soluble fiber, sugar alcohol, and nicotine mixture appears as a dense matrix 602 domain, while the oil and the nicotine are partitioned in the oil domains 604. This partition stabilizes the nicotine in the chewable dissolvable nicotine tablets. For example, as shown in Table 1, all nicotine degradants at week 16 were undetectable under controlled conditions of 25° C., 65% relative humidity, and atmospheric pressure.

TABLE 1

% of Target Nicotine Concentration of Chewable Chewable dissolvable nicotine tablets at Week 16 % of Target Nicotine Concentration of Chewable Dissolvable Nicotine piece at week 16 (Average, n = 3)

| Myosmine (%) | Nornicotine (%) | Anabasine (%) | Cotinine (%) | Anatabine (%) | Nicotine-dioxide (%) | beta-nioctyrine (%) |
|---|---|---|---|---|---|---|
| <BLOQ | <BLOQ | <BLOQ | <BLOQ | <BLOQ | <BLOQ | <BLOQ |

Figure 3:
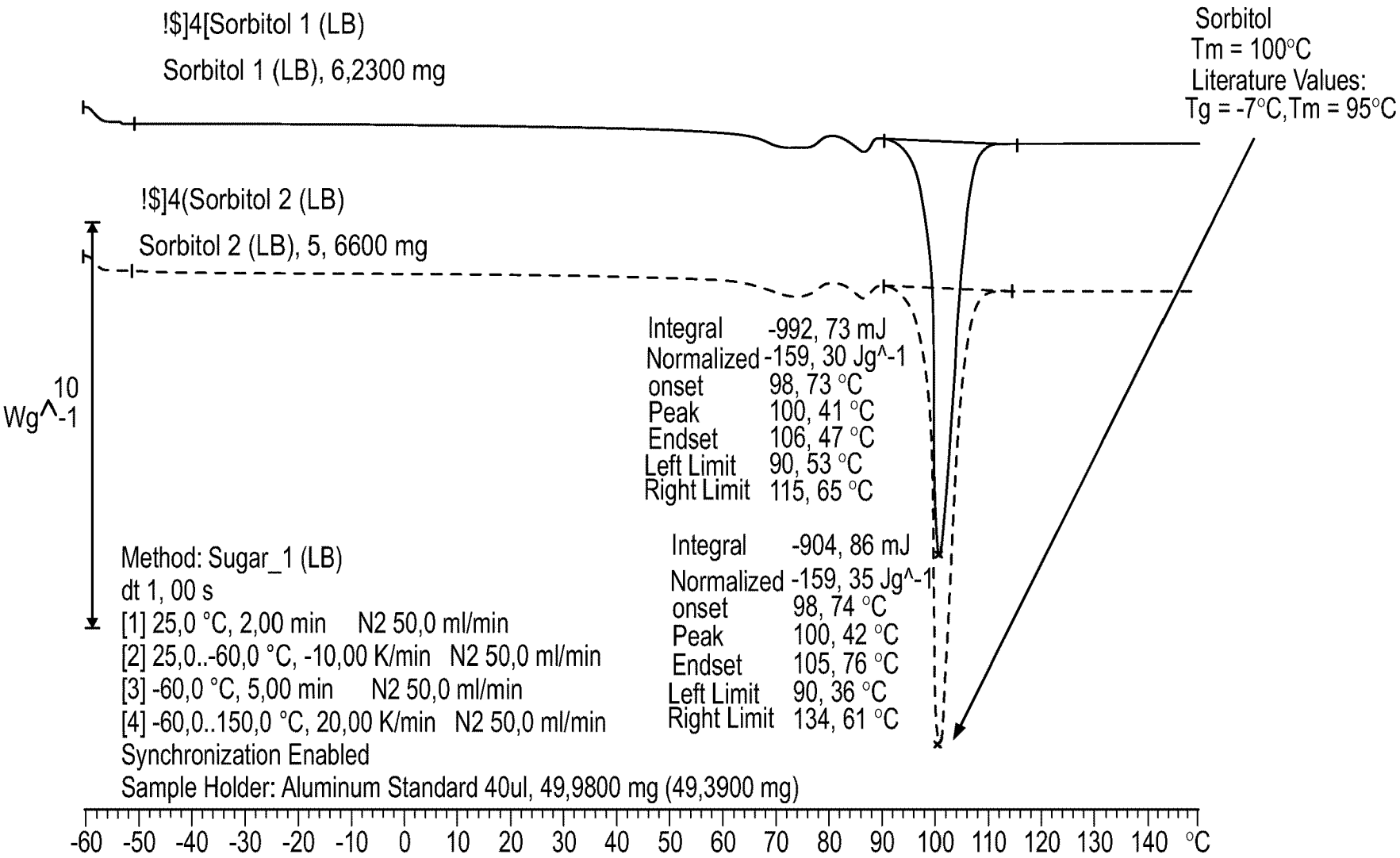
FIG. 3 depicts differential scanning calorimetry data for sorbitol provided herein.
Figure 4:
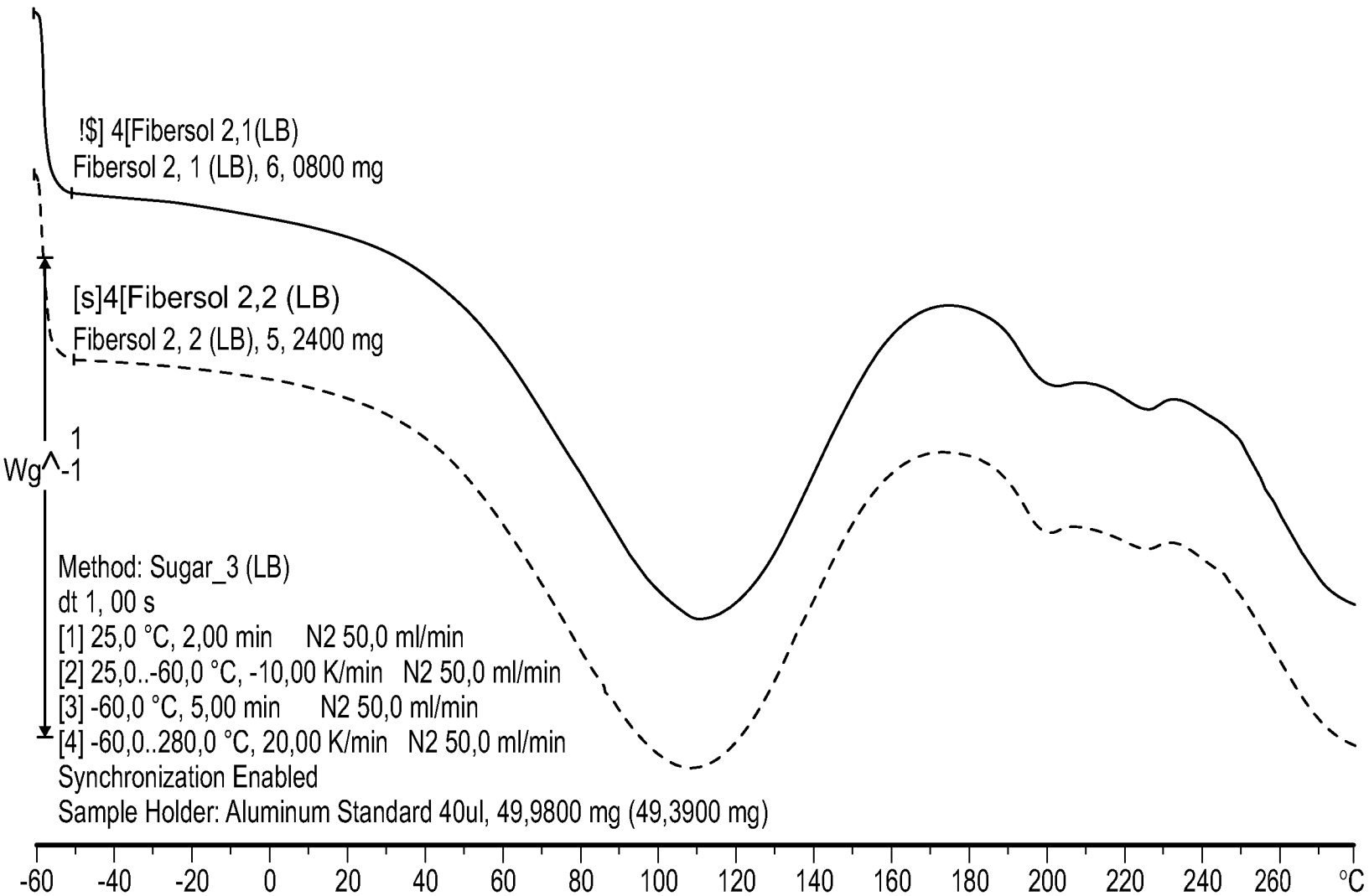
FIG. 4 depicts differential scanning calorimetry data for maltodextrin provided herein.
Figure 5:
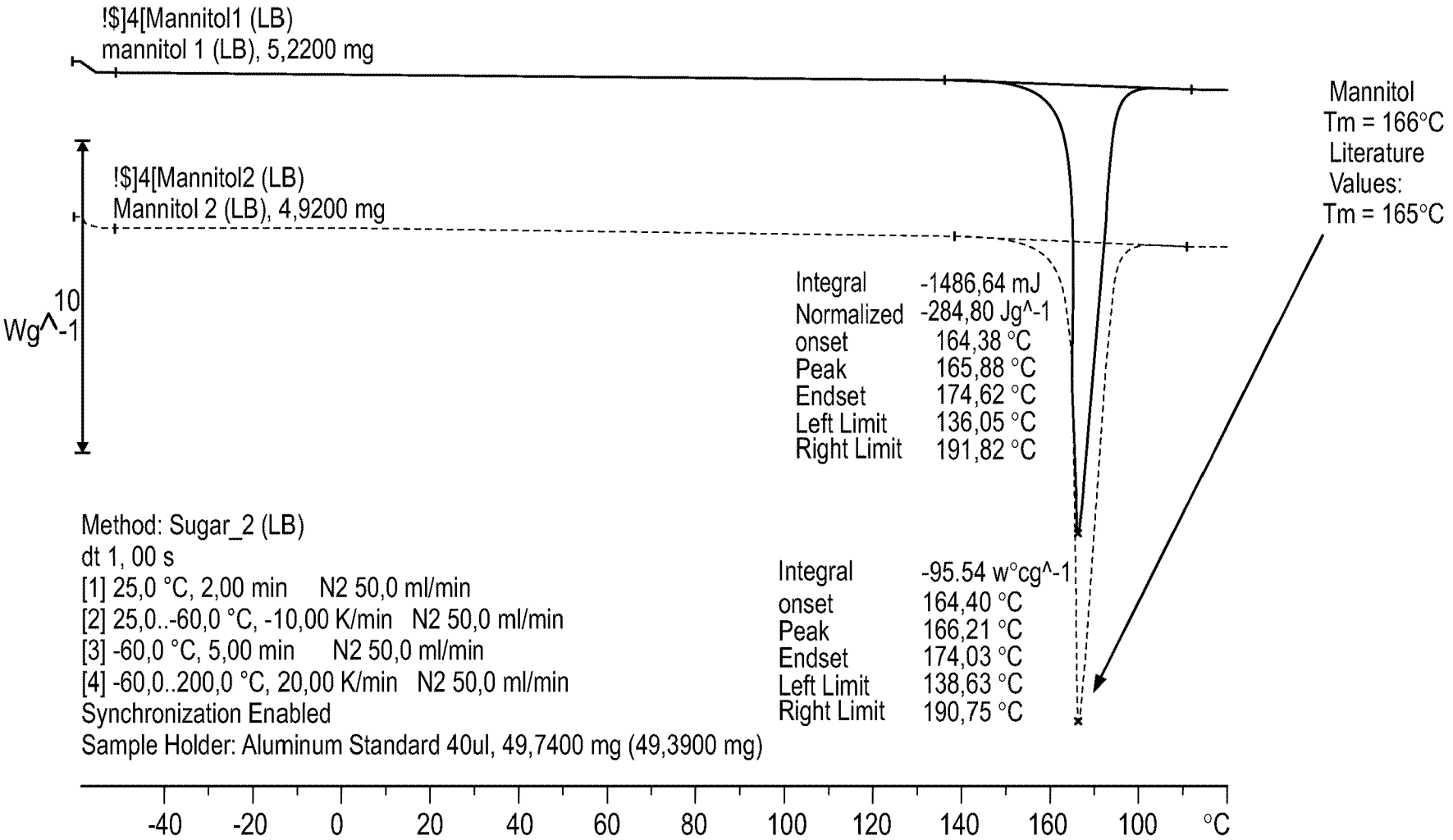
FIG. 5 depicts differential scanning calorimetry data for mannitol provided herein.
Figure 6A:
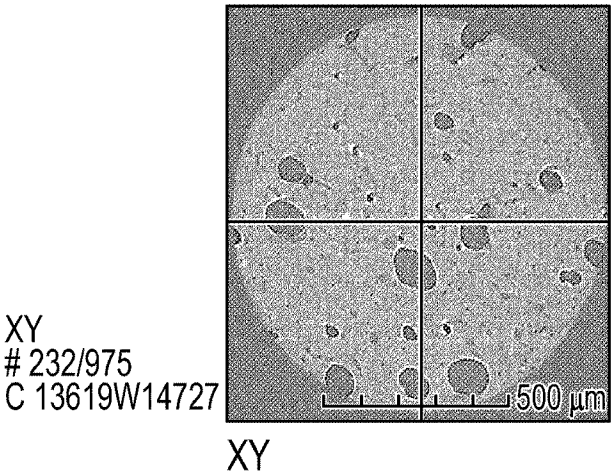
FIGS. 6A-6D depict x-ray microtomography cross sections of a chewable dissolvable nicotine tablet provided herein.
Figure 6B:
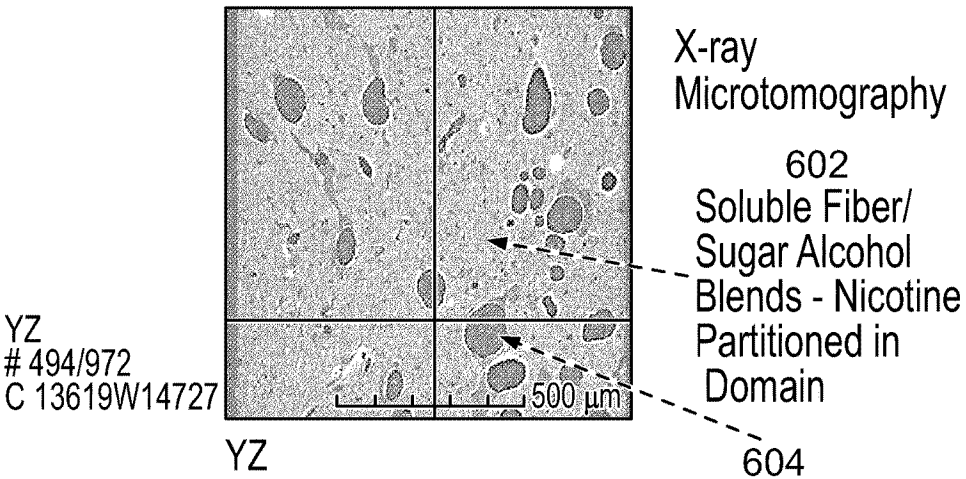
Figure 6C:
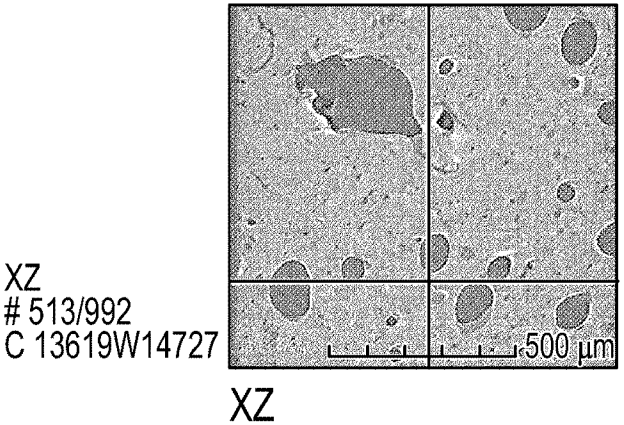
Figure 6D:
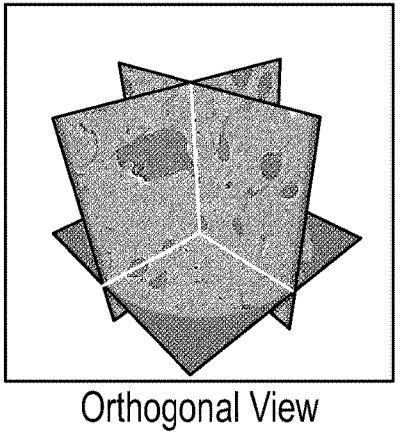

Still referring to FIG. 2, no peaks are present at 100° C., which is the melting point of sorbitol, as depicted in FIG. 3, the DSC for pure sorbitol does show a melting point at 100° C. FIG. 5 shows the DSC for pure mannitol with a melting temperature at 166° C. The mannitol melting point is not present at 166° C. in FIG. 2, the solid mixture. FIG. 4 shows the DSC for pure maltodextrin as a reference sample. The mixture of mannitol, sorbitol and maltodextrin is amorphous for the example shown in FIG. 2. Therefore, the product does not have "crumbly" texture in the chewable product.

Figure 7:
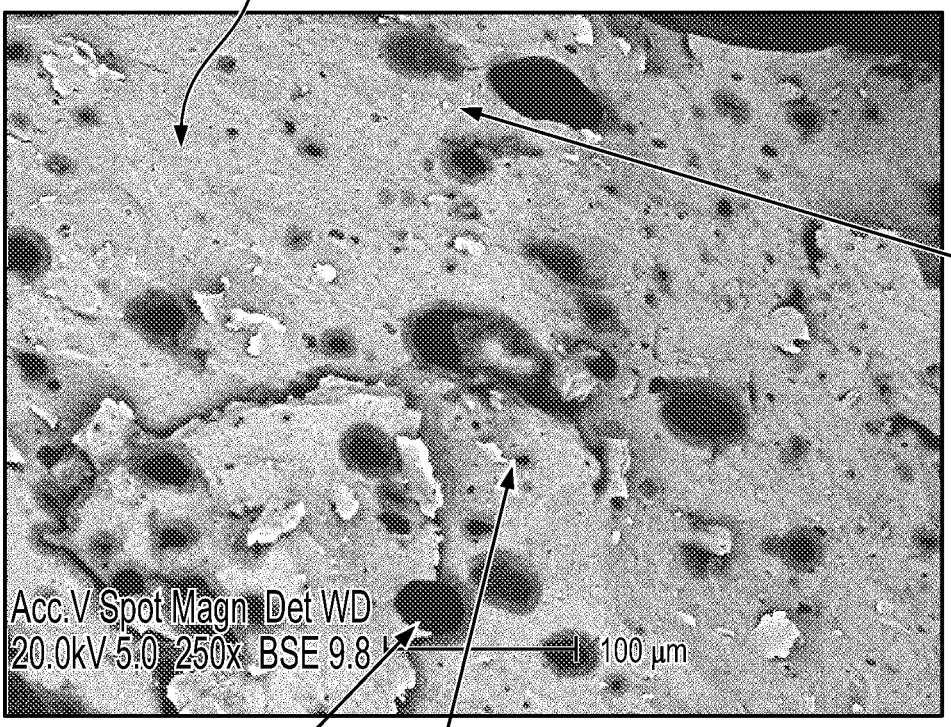
FIG. 7 depicts an image of a chewable dissolvable nicotine tablet provided herein generated by a scanning electron microscope.

The chewable dissolvable nicotine tablet 110 can have a variety of colors. In some cases, the chewable dissolvable nicotine tablet 110 has an off-white color. For example, referring to FIG. 7, titanium dioxide ($TiO_2$) 706 can be added to the soluble fiber, sugar alcohol blend, and cellulose fiber mixture. The dark voids 702 dispersed throughout the dense matrix 704 indicate pockets of oil, flavor, and/or nicotine. In some cases, natural and artificial coloring can be added to a molten mixture that forms the solid solution during a molding process to form chewable dissolvable nicotine tablets 110 having a predetermined color. Encapsulated flavors can be added during the extrusion process to create speckles, patterns, or dots within a chewable dissolvable nicotine tablet.

Soluble Fiber

Soluble fiber dissolves in ambient water. Insoluble fiber does not dissolve in ambient water. Soluble fibers can attract water and form a gel. Not only are many soluble fibers safe for consumption, but some soluble fibers are used as a dietary supplement. As a dietary supplement, soluble fiber can slow down digestion and delay the emptying of a stomach. Instead of using soluble fiber as a mere additive, however, chewable dissolvable nicotine tablets provided herein include a solid solution of soluble fiber and sugar alcohols that can be combined with nicotine (and optionally other additives) to provide a satisfying tactile and/or flavor experience.

Any suitable soluble fiber or combination of soluble fibers can be used to form a soluble-fiber solution provided herein. Suitable soluble fibers include maltodextrin, psyllium, pectin, guar gum, gum arabic, inulin, arabinoxylans, cellulose, and many other plant components such as resistant starch, resistant dextrins, lignin, pectins, beta-glucans, and oligosaccharides or a combination thereof. In some cases, a chewable dissolvable nicotine tablet provided herein can include a digestion-resistant soluble fiber. A digestion resistant soluble fiber can include starch linkages that remain undigested by enzymes of the human digestive tract. In some cases, a chewable dissolvable nicotine tablet provided herein can include a digestion-resistant maltodextrin. In some cases, a digestion-resistant maltodextrin can be derived from maze. Suitable maltodextrins can include those that are soluble in water up to 70% at 20° C., have a viscosity of about 15 cps for a 30% solution at 30° C., a DE in the range of about 6-16, and contain random α-1,2, α-1,3, α-1,4, β-1,2, β-1,3 and β-1,4 glucose linkages in addition to the normal α-1,4 glucose linkages found in partially hydrolyzed starch. See, e.g., U.S. Pat. Nos. 5,410,035; 5,380,717, which are hereby incorporated by reference. For example, Fibersol®-2 is a maltodextrin of DE 6-10 processed from corn starch using hydrochloric acid and enzymes, which can be used as the soluble fiber in a chewable dissolvable nicotine tablet provided herein. Fibersol®-2 is partially indigestible because human digestive enzymes are incapable of digesting β 1,2, β 1,3 and β 1,6 glucose bonds. See, e.g., U.S. Pat. No. 6,203,842. Other starch sources such as potato, rice, wheat, barley, peas, beans, lentils, oats, or tapioca can be processed to form digestion-resistant soluble fiber. A digestion resistant soluble fiber includes starch linkages that cannot be hydrolyzed by enzymes of the human digestive tract. In some cases, suitable soluble fibers include Pinefibre, Pinefibre C, Dexflow and Pineflow as discussed in U.S. Pat. No. 5,236,719, which is hereby incorporated by reference. Soluble fiber used in a chewable dissolvable nicotine tablet provided herein can be GRAS by the Food and Drug Administration or another appropriate private, state, or national regulatory agency.

A chewable dissolvable nicotine tablet provided herein can include at least 20 weight percent of soluble fiber, at least 25 weight percent of soluble fiber, at least 30 weight percent of soluble fiber, at least 35 weight percent of soluble fiber, at least 40 weight percent of soluble fiber, at least 45 weight percent of soluble fiber, at least 50 weight percent of soluble fiber, at least 55 weight percent of soluble fiber, at least 60 weight percent of soluble fiber, at least 65 weight percent of soluble fiber, or at least 70 weight percent of soluble fiber. In some cases, a chewable dissolvable nicotine tablet provided herein can include at least 20 weight percent maltodextrin, at least 25 weight percent maltodextrin, at least 30 weight percent maltodextrin, at least 35 weight percent maltodextrin, at least 40 weight percent maltodextrin, at least 45 weight percent maltodextrin, at least 50 weight percent maltodextrin, at least 55 weight percent maltodextrin, at least 60 weight percent maltodextrin, at least 65 weight percent maltodextrin, or at least 70 weight percent maltodextrin. In some cases, a chewable dissolvable nicotine tablet provided herein can include less than 70 weight percent maltodextrin, less than 60 weight percent maltodextrin, less than 50 weight percent maltodextrin, or less than 40 weight percent maltodextrin. In some cases, a chewable dissolvable nicotine tablet provided herein can include at least 20 weight percent digestion-resistant maltodextrin, at least 25 weight percent digestion-resistant maltodextrin, at least 30 weight percent digestion-resistant maltodextrin, at least 35 weight percent digestion-resistant maltodextrin, at least 40 weight percent digestion-resistant maltodextrin, at least 45 weight percent digestion-resistant maltodextrin, at least 50 weight percent digestion-resistant maltodextrin, at least 55 weight percent digestion-resistant maltodextrin, at least 60 weight percent digestion-resistant maltodextrin, at least 65 weight percent digestion-resistant maltodextrin, or at least 70 weight percent digestion-resistant maltodextrin.

Sugar Alcohol(s)

Sugar alcohols, also known as polyols or polyhydric alcohols, are hydrogenated carbohydrates that can be used as sugar replacers. Sugar alcohols are non-cariogenic, low-glycemic, low-energy, low-insulinemic, low digestible, osmotic, carbohydrates that dissolve in water. Sugar alcohols can be used in comestible products to take advantage of these various properties. For example, sugar alcohols can be used to replace sugar because sugar alcohols contain fewer calories per gram than sugar and sugar alcohols do not cause tooth decay. A chewable digestible nicotine tablet described herein can include at least one sugar alcohol combined with soluble fiber to provide a solid solution that can hold nicotine (and other optional additive) to provide a satisfying tactile and/or flavor experience.

Any suitable sugar alcohol can be used in a solid solution provided herein. Suitable sugar alcohols used in a chewable dissolvable nicotine tablet provided herein can be monosaccharide-derived (e.g., sorbitol, mannitol, xylitol, erythritol), disaccharide-derived (e.g., isomalt, lactitol, maltitol), or polysaccharide-derived mixtures (e.g., maltitol syrup, hydrogenated starch hydrolysates [HSH]). Sugar alcohols used in a chewable dissolvable nicotine tablet provided herein can be a sugar alcohol generally recognized as safe ("GRAS") or approved food additives by the Food and Drug Administration or another appropriate private, state, or national regulatory agency.

A chewable dissolvable nicotine tablet provided herein can include at least 20 weight percent of one or more sugar alcohols, at least 25 weight percent of one or more sugar alcohols, at least 30 weight percent of one or more sugar alcohols, at least 35 weight percent of one or more sugar alcohols, at least 40 weight percent of one or more sugar alcohols, at least 45 weight percent of one or more sugar alcohols, at least 50 weight percent of sugar alcohol, or at least 55 weight percent of one or more sugar alcohols. In some cases, a chewable dissolvable nicotine tablet provided herein can include less than 75 weight percent of one or more sugar alcohols, less than 60 weight percent of one or more sugar alcohols, or less than 50 weight percent of one or more sugar alcohols. In some cases, a chewable dissolvable nicotine tablet provided herein can include at least 2 weight percent sorbitol, at least 5 weight percent sorbitol, at least 10 weight percent sorbitol, at least 15 weight percent sorbitol, at least 20 weight percent sorbitol, at least 25 weight percent sorbitol, at least 30 weight percent sorbitol, or at least 35 weight percent sorbitol. In some cases, a chewable dissolvable nicotine tablet provided herein can include at least 2 weight percent mannitol, at least 5 weight percent mannitol, at least 10 weight percent mannitol, at least 15 weight percent mannitol, at least 20 weight percent mannitol, at least 25 weight percent mannitol, at least 30 weight percent mannitol, or at least 35 weight percent mannitol.

Additives

A variety of additives can be included in a chewable dissolvable nicotine tablet provided herein. The additives can include alkaloids, minerals, vitamins, dietary supplements, nutraceuticals, energizing agents, soothing agents, coloring agents, amino acids, chemsthetic agent, antioxidants, food grade emulsifiers, pH modifiers, botanicals (e.g., green tea), teeth whitening (e.g., SHMP), therapeutic agents, sweeteners, flavorants, and combinations thereof. In some cases, the additives include nicotine, sweeteners, and flavorants. With certain combinations of nicotine, sweeteners, and flavorants, a chewable dissolvable nicotine tablet provided herein may provide a flavor profile and tactile experience similar to certain tobacco products.

Nicotine

Nicotine used in chewable dissolvable nicotine tablet provided herein can be tobacco-derived nicotine, synthetic nicotine, or a combination thereof. In some cases, the nicotine can be liquid nicotine. Liquid nicotine can be purchased from commercial sources, whether tobacco-derived or synthetic. In some cases, a chewable dissolvable nicotine tablet provided herein includes between 0.1 mg and 20.0 mg of nicotine. In some cases, a chewable dissolvable nicotine tablet provided herein includes between 0.5 mg and 10.0 mg of nicotine. In some cases, a chewable dissolvable nicotine tablet provided herein includes between 1.0 mg and 6.0 mg of nicotine. In some cases, a chewable dissolvable nicotine tablet provided herein includes between 1.0 mg and 3.0 mg of nicotine. In some cases, cellulosic fiber-nicotine mixtures can be generated in the methods described in U.S. Application No. 61/856,409, which is incorporated herein by reference, and incorporated into a chewable dissolvable nicotine tablet provided herein.

Tobacco-derived nicotine can include one or more other tobacco organoleptic components other than nicotine. The tobacco-derived nicotine can be extracted from raw (e.g., green leaf) tobacco and/or processed tobacco. Processed tobaccos can include fermented and unfermented tobaccos, dark air-cured, dark fire cured, burley, flue cured, and cigar filler or wrapper, as well as the products from the whole leaf stemming operation. The tobacco can also be conditioned by heating, sweating and/or pasteurizing steps as described in U.S. Publication Nos. 2004/0118422 or 2005/0178398, which are each hereby incorporated by reference. Fermenting typically is characterized by high initial moisture content, heat generation, and a 10 to 20% loss of dry weight. See, e.g., U.S. Pat. Nos. 4,528,993; 4,660,577; 4,848,373; and 5,372,149, which are each hereby incorporated by reference. By processing the tobacco prior to extracting nicotine and other organoleptic components, the tobacco-derived nicotine may include ingredients that provide a favorable experience. The tobacco-derived nicotine can be obtained by mixing cured tobacco or cured and fermented tobacco with water or another solvent (e.g., ethanol) followed by removing the insoluble tobacco material. The tobacco extract may be further concentrated or purified. In some cases, select tobacco constituents can be removed. Nicotine can also be extracted from tobacco in the methods described in the following patents: U.S. Pat. Nos. 2,162,738; 3,139,436; 3,396,735; 4,153,063; 4,448,208; and 5,487,792, which are each hereby incorporated by reference.

Liquid nicotine can be pure, substantially pure, or diluted prior to combination with a molten mixture of soluble fiber and one or more sugar alcohols. A diluting step is optional. In some cases, liquid nicotine is mixed with cellulosic fibers prior to adding the nicotine to a molten mixture of soluble fiber and one or more sugar alcohols.

The nicotine can also be purchased from commercial sources, whether tobacco-derived or synthetic. In some cases, the chewable dissolvable nicotine tablet can include a derivative of nicotine (e.g., a salt of nicotine).

The nicotine degradants are non-detectable at 16 weeks under controlled conditions of 25° C., 65% relative humidity, and atmospheric pressure (see Table 1.)

Antioxidants

A chewable dissolvable nicotine tablet 110 provided herein can include one or more antioxidants. Antioxidants can result in a significant reduction in the conversion of nicotine into nicotine-N-oxide when compared to nicotine products without antioxidants. In some cases, a chewable dissolvable nicotine tablet provided herein can include 0.01 and 5.00 weight percent antioxidant, between 0.05 and 1.0 weight percent antioxidant, between 0.10 and 0.75 weigh percent antioxidant, or between 0.15 and 0.5 weight percent antioxidant. Suitable examples of antioxidants include ascorbyl palmitate (a vitamin C ester), BHT, ascorbic acid (Vitamin C), and sodium ascorbate (Vitamin C salt). In some cases, monosterol citrate, tocopherols, propyl gallate, tertiary butylhydroquinone (TBHQ), butylated hydroxyanisole (BHA), Vitamin E, or a derivative thereof can be used as the antioxidant. For example, ascorbyl palmitate can be the antioxidant in the formulations listed in Table I. Antioxidants can be incorporated into the solid solution during a mixing process (e.g., added to an extruder mixing the ingredients).

Sweeteners

A variety of synthetic and/or natural sweeteners can be used as additives in the chewable dissolvable nicotine tablet 110. Suitable natural sweeteners include sugars, for example, monosaccharides, disaccharides, and/or polysaccharide sugars, and/or mixtures of two or more sugars. According to some embodiments, the chewable dissolvable nicotine tablet 110 includes one or more of the following: sucrose or table sugar; honey or a mixture of low molecular weight sugars not including sucrose; glucose or grape sugar or corn sugar or dextrose; molasses; corn sweetener; corn syrup or glucose syrup; fructose or fruit sugar; lactose or milk sugar; maltose or malt sugar or maltobiose; sorghum syrup; mannitol or manna sugar; sorbitol or d-sorbite or d-sobitol; fruit juice concentrate; and/or mixtures or blends of one or more of these ingredients. A chewable dissolvable nicotine tablet provided herein can also include non-nutritive sweeteners. Suitable non-nutritive sweeteners include: stevia, saccharin; aspartame; sucralose; or acesulfame potassium.

Flavorants

The chewable dissolvable nicotine tablet 110 can optionally include one or more flavorants. The flavorants can be natural or artificial. For example, suitable flavorants include wintergreen, cherry and berry type flavorants, various liqueurs and liquors (such as Dramboui, bourbon, scotch, and whiskey) spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang, sage, fennel, pimenta, ginger, anise, chai, coriander, coffee, liquorish, and mint oils from a species of the genus Mentha, and encapsulated flavors. Mint oils useful in particular embodiments of the chewable dissolvable nicotine tablet 110 include spearmint and peppermint. Synthetic flavorants can also be used. In some cases, a combination of flavorants can be combined to imitate a tobacco flavor. The particular combination of flavorants can be selected from flavorants that are GRAS in a particular country, such as the United States. Flavorants can also be included in the chewable dissolvable nicotine tablet as encapsulated flavorants.

In some cases, the flavorants in the chewable dissolvable nicotine tablet 110 are limited to less than 20 weight percent in sum. In some cases, the flavorants in the chewable dissolvable nicotine tablet 110 are limited to be less than 10 weight percent in sum. For example, certain flavorants can be included in the chewable dissolvable nicotine tablet 110 in amounts of about 1 weight percent to 5 weight percent.

Other Additives

Chewable dissolvable nicotine tablets provided herein may optionally include additives in addition to nicotine. For example, these additives can further include non-nicotine alkaloids, dietary minerals, vitamins, dietary supplements, therapeutic agents, and fillers.

Chewable dissolvable nicotine tablets provided herein can also include vitamins, dietary minerals, other dietary supplements, and/or therapeutic agents. For example, suitable vitamins include Vitamins A, B1, B2, B6, C, D2, D3, E, F, and K. For example, a chewable dissolvable nicotine tablet 110 can include C-vitamins with or without the presence of nicotine. Suitable dietary minerals include calcium (as carbonate, citrate, etc.) or magnesium (as oxide, etc.), chromium (usually as picolinate), and iron (as bis-glycinate). One or more dietary minerals could be included in a chewable dissolvable nicotine tablet with or without the use of other additives. Other dietary supplements and/or therapeutic agents can also be included as additives.

The chewable dissolvable nicotine tablet provided herein can also include fillers such as starch, di-calcium phosphate, lactose, sorbitol, mannitol, and microcrystalline cellulose, calcium carbonate, dicalcium phosphate, calcium sulfate, clays, silica, sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides), stabilizers (e.g., ascorbic acid and monosterol citrate, BHT, or BHA), disintegrating agents (e.g., starch, sodium starch glycolate, cross caramellose, cross linked PVP), pH stabilizers, or preservatives. In some cases, an amount of filler in the chewable dissolvable nicotine tablet 110 is limited to less than 10 weight percent in sum. In some cases, an amount of filler in the chewable dissolvable nicotine tablet 110 is limited to be less than 5 weight percent in sum. In some cases, fillers can dissolve or disintegrate during use and thus result in a chewable dissolvable nicotine tablet that becomes more pliable during use.

Cellulosic Fibers

Chewable dissolvable nicotine tablets provided herein can include cellulosic fibers within a matrix of a solid solution provided herein. Cellulosic fibers can be mixed with soluble fibers and sugar alcohol(s) during an extrusion process. In some cases, as discussed above, cellulosic fibers can be mixed with liquid nicotine before that liquid nicotine is mixed with soluble fiber and sugar alcohol(s).

Cellulosic fiber used in a chewable dissolvable nicotine tablet provided herein can further include lignin and/or lipids. Suitable sources for cellulosic fibers include wood pulp, cotton, sugar beets, bran, citrus pulp fiber, switch grass and other grasses, Salix (willow), tea, and Populus (poplar), bamboo. In some cases, cellulosic fiber used in chewable dissolvable nicotine tablets provided herein can be chopped or shredded plant tissue comprising various natural flavors, sweeteners, or active ingredients. Cellulosic fiber used in chewable dissolvable nicotine tablets provided herein can include a plurality of fibers having a variety of dimensions. In some cases, cellulosic fiber used chewable dissolvable nicotine tablets provided herein can include one or more cellulosic fibers that are generally recognized as safe ("GRAS") for human consumption.

Cellulosic fibers suitable for inclusion in a chewable dissolvable nicotine tablet provided herein can have a variety of dimensions. The dimensions of included cellulosic fibers (in addition to the amount) can impact the release characteristics of the additives. For example, cellulosic fibers can be hydrophilic, thus water soluble additives (e.g., nicotine) can be added into solid solution. In some cases, cellulosic fiber used in a chewable dissolvable nicotine tablet provided herein can be processed to have an average fiber length of less than 200 micrometers. In particular embodiments, the fibers are between 25 and 125 micrometers. In some cases, the fibers are processed to have a length of 75 micrometers or less. Exemplary average lengths are in the range of 1 to 1000 micrometers, e.g., about 800, 500, 250, 100, 80, 75, 50, 25, 20, 15, 10, 8, 6, 5, 3, 2, or 1 micrometers or less. Dimensions of the cellulosic fibers (in addition to the amount) can impact the release characteristics of liquid nicotine from a chewable dissolvable nicotine tablet provided herein.

Cellulosic fiber used in chewable dissolvable nicotine tablets provided herein can have pores. In some cases, cellulosic fibers provided herein have pores sizes that range from between 3 nanometers to 300 nanometers. In some cases, cellulosic fibers provided herein have pores sizes that range from between 10 nanometers to 200 nanometers. In some cases, cellulosic fibers provided herein have pores sizes that range from between 20 nanometers to 100 nanometers. When mixing liquid nicotine with cellulosic fibers, nicotine can become absorbed into the pores in the cellulosic fibers and held there by van der Waals forces. The number, sizes, and size distribution, chemical, and physical surface properties of the pores can impact the release rate of nicotine incorporated into cellulosic fiber and into an oral product. The release rate can also be manipulated due to compression of cellulosic fiber (e.g., by chewing a chewable dissolvable nicotine tablet provided herein). The hydrophilicity of the cellulose fibers can be selected to provide a desired sensorial experience when included in an oral product. For example, cellulosic fiber can be hydrophilic, thus water soluble additives (e.g., nicotine) can preferentially be absorbed in cellulosic fiber.

Plasticizers

Chewable dissolvable nicotine tablets provided herein can also include one or more plasticizers. Plasticizers can soften the final chewable dissolvable nicotine tablet and thus increase its flexibility. Suitable plasticizers include propylene glycol, triacetin, glycerin, vegetable oil, and medium chain triglycerides. In some cases, the plasticizer can include phthalates. Esters of polycarboxylic acids with linear or branched aliphatic alcohols of moderate chain length can also be used as plasticizers. Moreover, plasticizers can facilitate the extrusion processes described below. In some cases, the chewable dissolvable nicotine tablet 110 can include up to 20 weight percent plasticizer. In some cases, a chewable dissolvable nicotine tablet provided herein includes between 0.05 and 10 weight percent plasticizer, between 1 and 8 weight percent plasticizer, or between 2 and 4 weight percent plasticizer. For example, a chewable dissolvable nicotine tablet provided herein can include about 3 to 6.5 weight percent of propylene glycol.

Molding Processes

Chewable dissolvable nicotine tablets provided herein can be produced by forming a molten mixture of soluble fiber, sugar alcohols (e.g., sorbitol and mannitol), and nicotine and shaping that molten mixture into individual chewable dissolvable nicotine tablets. The molten mixture is formed under controlled heating conditions such that a solution of soluble fiber, sugar alcohol(s), water, and nicotine is formed without degrading the nicotine or creating cross-linking between the sugar alcohol(s) and/or the soluble fiber. In some cases, a temperature of the molten mixture is maintained at a temperature below 150° C. In some cases, a rod or sheet of the molten mixture is extruded and cut into individual chewable dissolvable nicotine tablets. In some cases, a molten mixture of soluble fiber, sugar alcohol(s), and nicotine can be injection molded, compression molded, or injection-compression molded.

Cooking processes forming dissolvable edible products sometimes utilize the cross-linking of sugars or sugar alcohols that occurs after heating to caramelization temperatures. Such heating results in a desirable caramelization of the product. The relatively high temperatures required for caramelization, however, can accelerate the degradation of nicotine because of the high temperatures and other factors (e.g., residence time during extrusion). Because nicotine degradation can be accelerated when exposed to elevated temperatures over extended periods of time, the temperature of a molten mixture provided herein can be maintained at a temperature of 150° C. or below over a processing time (e.g., a residence time of five to ten minutes or less if an extrusion process is utilized). In some cases, a molten mixture provided herein is heated to a temperature of between 80° C. and 150° C. In some cases, a molten mixture provided herein is heated to a temperature of between 100° C. and 110° C. When cooled below its glass transition temperature, a molten mixture provided herein solidifies into an amorphous, non-porous, soluble fiber matrix containing nicotine. A solid solution of soluble fiber and sugar alcohol(s), however, can provide a chewable dissolvable nicotine tablet provided herein with a suitable dissolution time when place in an adult consumer's mouth. A chewable dissolvable nicotine tablet provided herein can also be chewable.

Figure 8:
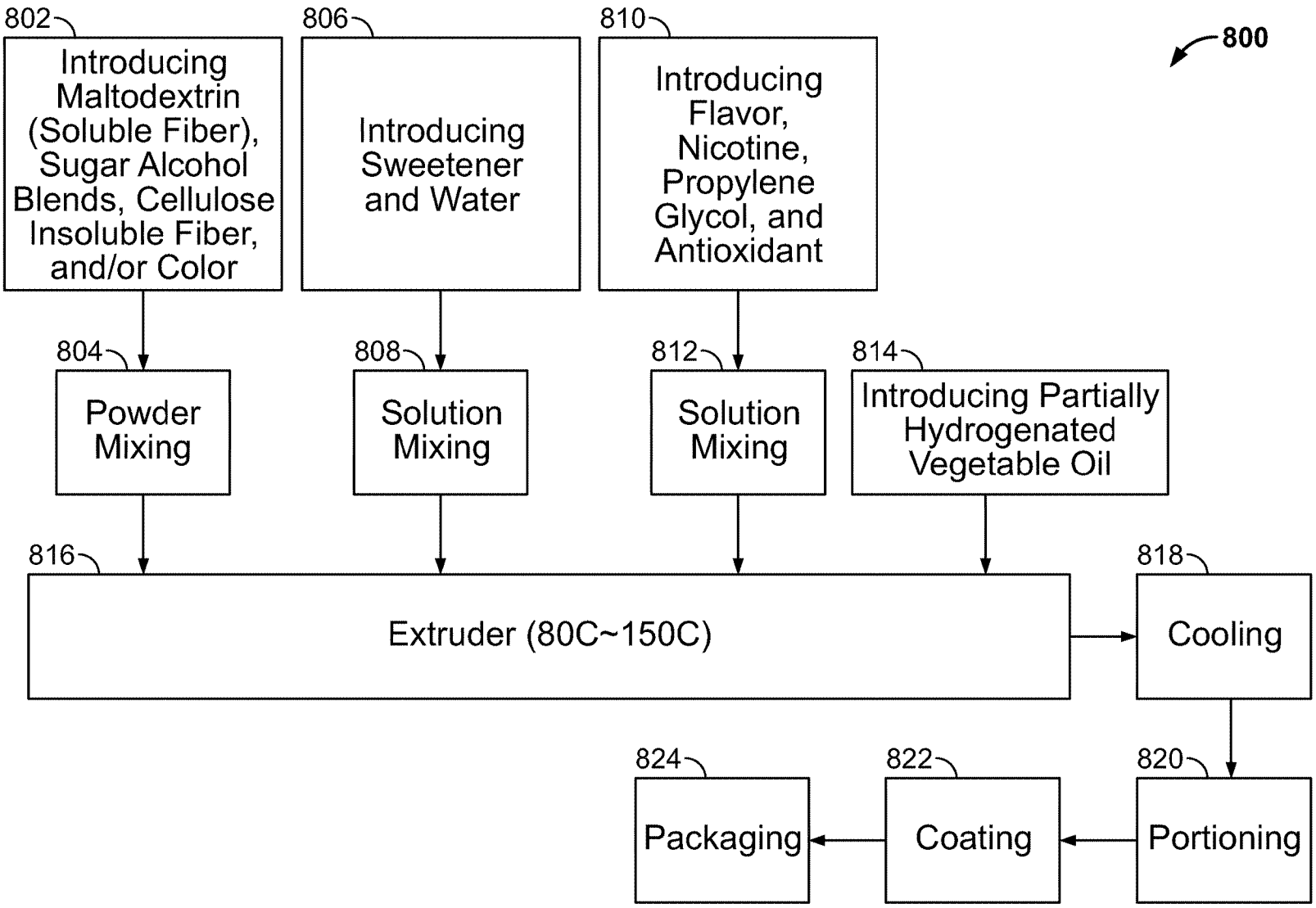
FIG. 8 is a process diagram for making chewable dissolvable nicotine tablets according to a method provided herein.

A molten mixture can be mixed and heated in any suitable but controlled method. In some cases, such as shown in FIG. 8, ingredients for a molten mixture can be combined in an extruder and mixed in a continuous extrusion process. Unlike a traditional cooking method chewable dissolvable nicotine tablet provided herein can have attributes precisely controlled by extruder operation parameters, such as feed rate, barrel temperature profile, screw design, rpms, etc.

Water added to molten mixture can be maintained at a percentage of less than 15 weight percent. A water content of a chewable dissolvable nicotine tablet provided herein can be controlled in the extrusion process to ensure that the molten mixture becomes a solid solution. In some cases, a molten mixture can have a water content of less than 15 weight percent. In some cases, water content in a chewable dissolvable nicotine tablet provided herein ranges from 0.5 weight percent to 7 weight percent. In some cases, water content in a chewable dissolvable nicotine tablet provided herein ranges from 1 weight percent to 5 weight percent. Referring to the extrusion process 800 illustrated in FIG. 8, soluble fibers (e.g., maltodextrin or digestion resistant maltodextrin), sugar alcohol or blend of multiple sugar alcohols (e.g., sorbitol and mannitol), cellulose insoluble fibers, and color (e.g., $TiO_2$) can be introduced 802 into the extrusion process 800 and can undergo a powder mixing 804 before progressing to the extruder 816. A mixing extruder 816 can include multiple stages controlled to be maintained at a predetermined temperature. As shown, extruder 816 can include stages having temperatures ranging between 80° C. and 150° C. For example, an extruder can have seven stages with each stage controlled to a specific temperature (e.g., some stages range between 80° C. and 100° C., from 100° C. and 110° C., from 100° C. and 110° C., from 100° C. and 130° C., from 100° C. and 130° C., from 100° C. and 130° C., from 80° C. and 120° C.). This extruder can rotate at approximately 40-80 revolutions per minute. A mixture of sweetener and water can also be introduced 806 into the process 800 and can also undergo a solution mixing step 808 for a period of time before progressing to the extruder 816. Any combination of nicotine, flavor, propylene glycol, and antioxidants can also be introduced 810 into the process 800 and can undergo a solution mixing step 812 for a period of time before progressing to the extruder 816. In some cases, this process allows nicotine to be incorporated into the process with minimum exposure to temperature and air. A plasticizer (e.g., partially hydrogenated vegetable oil) can also undergo a solution mixing step 814 for a period of time before progressing into the extruder 816. The extruder 816 can maintain a warm internal temperature (e.g., between approximately 60° C. to 160° C.). The low temperature of the extruder 816 has the advantage of reducing undesirable degradation of additives (e.g., nicotine) and cross-linking of the sugar alcohol(s). The molten mixture can exit the extruder 816 and be allowed to cool (e.g., to ambient temperature) to form a viscous material including a solid solution of soluble fiber, sugar alcohol(s), nicotine, and other additives, which is then cut in a portioning process 820 to form individual chewable dissolvable nicotine tablets. Portioning process 820 can include a process of rounding the edges of the chewable dissolvable nicotine tablets. For example, a pelletizer can be used to round the edges. After portioning, the chewable dissolvable nicotine tablets can undergo a coating process 822 and a packaging process 824, each of which is discussed above.

In addition to extrusion, there are other methods for mixing and carefully controlling the temperature of a molten mixture used to form chewable dissolvable nicotine tablets provided herein.

Other Embodiments

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

What is claimed is:

1. A chewable dissolvable nicotine tablet receivable in an oral cavity of an adult consumer, the chewable dissolvable nicotine tablet comprising:

a matrix including oral-soluble maltodextrin fibers in an amount of from 55 weight percent to 70 weight percent by weight of the tablet;

non-tobacco cellulosic fibers in an amount of from 0.01 weight percent to 10 weight percent by weight of the tablet, wherein the non-tobacco cellulosic fibers having an average fiber length between 25 micrometers and 125 micrometers; and sugar alcohols in an amount of from 20 weight percent to 40 weight percent by weight of the tablet, wherein the sugar alcohols are selected from the group consisting of mannitol, sorbitol, xylitol, erythritol, isomalt, lactitol, maltitol, maltitol syrup, hydrogenated starch hydrolysates, and combinations thereof, and wherein the oral-soluble maltodextrin fibers and the sugar alcohols each have a glass transition temperature in the range of −75° C. to 25° C.;

a plurality of domains dispersed in the matrix, each of the domains including an oil, wherein the oil is present in an amount of from 2 weight percent to 15 weight percent by weight of the tablet, and wherein the oil is selected from the group consisting of hydrogenated oil, palm kernel oil, coconut oil, corn oil, cotton seed oil, olive oil, peanut oil, canola oil, sesame oil, soybean oil, rapeseed oil, safflower oil, sunflower oil, mustard oil, almond oil, beech nut oil, cashew oil, hazelnut oil, macadamia oil, pecan oil, pine nut oil, pistachio oil, walnut oil, grapefruit seed oil, lemon oil, orange oil, pumpkin oil, watermelon seed oil, citrus oils, oils from melons and gourd seeds, flaxseed oil, cocoa butter, and combinations thereof; and a nicotine source including nicotine, a nicotine derivative, or both nicotine and a nicotine derivative, wherein at least one domain of the plurality of domains includes a mixture of the nicotine source and the oil, wherein the nicotine source is present in the tablet in an amount of from 0.1 milligram to 20 milligram, wherein the nicotine source is released from the tablet when the tablet is chewed or dissolved within the oral cavity, wherein the oral cavity has a temperature greater than the melting transition point of the oil, wherein the tablet is free of tobacco plant tissue, and wherein the tablet takes up to 1 hour to dissolve when placed in the oral cavity and takes between 1 minute and 30 minutes to dissolve when chewed by the adult consumer.

2. A chewable dissolvable nicotine tablet receivable in an oral cavity of an adult consumer, the chewable dissolvable nicotine tablet comprising:

a matrix including oral-soluble maltodextrin fibers in an amount of from 55 weight percent to 70 weight percent by weight of the tablet;

non-tobacco cellulosic fibers in an amount of from 0.01 weight percent to 10 weight percent by weight of the tablet, wherein the non-tobacco cellulosic fibers has an average fiber length between 25 micrometers and 125 micrometers; and sugar alcohols in an amount of from 20 weight percent to 40 weight percent by weight of the tablet, wherein the sugar alcohols are selected from the group consisting of mannitol, sorbitol, xylitol, erythritol, isomalt, lactitol, maltitol, maltitol syrup, hydrogenated starch hydrolysates, and combinations thereof, and wherein the oral-soluble maltodextrin fibers and the sugar alcohols each have a glass transition temperature in the range of −75° C. to 25° C.;

a plurality of domains dispersed in the matrix, wherein each of the domains includes an oil, wherein the oil present is in an amount of from 2 weight percent to 15 weight percent by weight of the tablet, wherein the oil is selected from the group consisting of hydrogenated oil, palm kernel oil, coconut oil, corn oil, cotton seed oil, olive oil, peanut oil, canola oil, sesame oil, soybean oil, rapeseed oil, safflower oil, sunflower oil, mustard oil, almond oil, beech nut oil, cashew oil, hazelnut oil, macadamia oil, pecan oil, pine nut oil, pistachio oil, walnut oil, grapefruit seed oil, lemon oil, orange oil, pumpkin oil, watermelon seed oil, citrus oils, oils from melons and gourd seeds, flaxseed oil, cocoa butter, and combinations thereof; and a nicotine source comprising nicotine, a nicotine derivative, or both nicotine and a nicotine derivative, wherein at least one of the plurality of domains includes a mixture of the nicotine source and the oil, wherein the tablet includes an amount of from 0.1 milligram to 20 milligram of the nicotine source, wherein the nicotine source is configured to be released from the tablet when the tablet is chewed or dissolved within the oral cavity, wherein the oral cavity has a temperature greater than the melting transition point of the oil, wherein the chewable dissolvable nicotine tablet is free of tobacco plant tissue, and wherein the tablet takes up to 1 hour to dissolve when placed in the oral cavity and takes between 1 minute and 30 minutes to dissolve when chewed by the adult consumer.

3. The tablet of claim 1, wherein the nicotine source is absorbed into the non-tobacco cellulosic fibers.

4. The tablet of claim 1, wherein the matrix further comprises a plasticizer in an amount of from 0.05 weight percent to 10 weight percent by weight of the tablet.

5. The tablet of claim 4, wherein the plasticizer is selected from the group consisting of propylene glycol, triacetin, glycerin, vegetable oil, triglycerides, and combinations thereof.

6. The tablet of claim 1, wherein the matrix further comprises an antioxidant in an amount of from 0.01 weight percent to 5 weight percent by weight of the tablet.

7. The tablet of claim 1, wherein the matrix further comprises water in an amount of from 0.5 weight percent to 7 weight percent by weight of the tablet.

8. The tablet of claim 1, wherein the tablet is shield shaped.

9. The tablet of claim 1, wherein the tablet is part of a sheet structure configured for subdivision into individual tablets.

10. A method of forming the tablet of claim 1, wherein the method comprises:

(a) forming a molten mixture by combining oral-soluble maltodextrin fibers, non-tobacco cellulosic fibers, sugar alcohols, an oil, a nicotine source, and water at a temperature of less than 150° C., wherein the molten mixture includes the oral-soluble maltodextrin fibers in an amount of from 55 weight percent to 70 weight percent by weight of the molten mixture;

the non-tobacco cellulosic fibers in an amount of from 0.01 weight percent to 10 weight percent by weight of the molten mixture, wherein an average fiber length of the non-tobacco cellulosic fibers ranges from 25 micrometers to 125 micrometers;

the sugar alcohols in an amount of from 20 weight percent to 40 weight percent by weight of the molten mixture, wherein the sugar alcohols are selected from the group consisting of mannitol, sorbitol, xylitol, erythritol, isomalt, lactitol, maltitol, maltitol syrup, hydrogenated starch hydrolysates, and combinations thereof, and wherein the oral-soluble maltodextrin fibers and the sugar alcohols each has a glass transition temperature that ranges from −75° C. to 25° C.:

the oil in an amount of from 2 weight percent to 15 weight percent by weight of the molten mixture, wherein the oil is selected from the group consisting of hydrogenated oil, palm kernel oil, coconut oil, corn oil, cotton seed oil, olive oil, peanut oil, canola oil, sesame oil, soybean oil, rapeseed oil, safflower oil, sunflower oil, mustard oil, almond oil, beech nut oil, cashew oil, hazelnut oil, macadamia oil, pecan oil, pine nut oil, pistachio oil, walnut oil, grapefruit seed oil, lemon oil, orange oil, pumpkin oil, watermelon seed oil, citrus oils, oils from melons and gourd seeds, flaxseed oil, cocoa butter, and combinations thereof;

the nicotine source in an amount of from 0.1 milligram to 20 milligram of the nicotine source, wherein the nicotine source includes nicotine, a nicotine derivative, or both nicotine and a nicotine derivative; and the water in an amount of from 0.5 weight percent to 7 weight percent by weight of the molten mixture;

(b) cooling the molten mixture to form a cooled mixture, wherein the cooled mixture includes a matrix that includes the oral-soluble maltodextrin fibers and the sugar alcohols, and a plurality of domains dispersed in the matrix, wherein each of the plurality of domains includes the oil, and wherein at least one of the plurality of domains includes a mixture of the nicotine source and the oil; and (c) portioning the cooled mixture into the plurality of chewable dissolvable nicotine tablets, wherein the chewable dissolvable nicotine tablets are free of tobacco plant tissue, and wherein the tablet takes up to 1 hour to dissolve when placed in the oral cavity and takes between 1 minute and 30 minutes to dissolve when chewed by the adult consumer.

11. The method of claim 10, wherein the method further comprises mixing the molten mixture with a plasticizer prior to the cooling.

12. The method of claim 10, wherein the portioning comprises cutting the cooled mixture.

13. The method of claim 10, wherein the method further comprises coating the plurality of chewable dissolvable nicotine tablets.

14. The method of claim 13, wherein the coating comprises a material selected from the group consisting of beeswax, zein, acetylated monoglyceride, hydroxypropylated potato starch, and combinations thereof.

15. The method of claim 13, wherein the coating comprises a material selected from the group consisting of methylcellulose, hydroxypropyl methylcellulose, carboxymethyl cellulose, ethyl cellulose, gelatin, and combinations thereof.

16. The method of claim 13, wherein the coating comprises a material selected from the group consisting of mannitol, sorbitol, xylitol, erythritol, isomalt, lactitol, maltitol, maltitol syrup, hydrogenated starch hydrolysates, and combinations thereof.

17. The method of claim 11, wherein the plasticizer comprises partially hydrogenated vegetable oil.

18. The method of claim 11, wherein the plasticizer comprises propylene glycol.

19. The method of claim 10, wherein the forming further comprises adding an antioxidant to the molten mixture, wherein the molten mixture includes the antioxidant in an amount of from 0.01 weight percent to 5 weight percent by weight of molten mixture.

20. The method of claim 10, wherein the forming is performed at a temperature ranging from 100° C. to 110° C.

* * * * *